US009241855B2

(12) United States Patent
Lapointe

(10) Patent No.: US 9,241,855 B2
(45) Date of Patent: Jan. 26, 2016

(54) FURNITURE MEMBER AND POWER RECLINE AND LIFT MECHANISM

(71) Applicant: Larry P. Lapointe, Temperance, MI (US)

(72) Inventor: Larry P. Lapointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 0 days.

(21) Appl. No.: 14/475,175

(22) Filed: Sep. 2, 2014

(65) Prior Publication Data

US 2014/0368011 A1 Dec. 18, 2014

Related U.S. Application Data

(63) Continuation-in-part of application No. 13/611,873, filed on Sep. 12, 2012, now Pat. No. 8,991,925.

(51) Int. Cl.
*A61G 5/14* (2006.01)
*A61G 5/12* (2006.01)

(52) U.S. Cl.
CPC ..... *A61G 5/14* (2013.01); *A61G 2005/127* (2013.01)

(58) Field of Classification Search
CPC ..... A47C 1/02; A47C 1/024; A47C 1/034; A61G 5/14; A61G 2005/127
See application file for complete search history.

(56) References Cited

U.S. PATENT DOCUMENTS 4,786,107 A * 11/1988 Crockett ..... A61G 5/14 297/330
4,852,939 A 8/1989 Krauska
4,946,222 A * 8/1990 Matson ..... A47C 1/0345 297/325
5,288,126 A 2/1994 Saul et al.
5,466,046 A 11/1995 Komorowski et al.
5,641,201 A * 6/1997 Casey ..... A61G 5/14 297/326
5,730,494 A 3/1998 LaPointe et al.
5,806,920 A 9/1998 Blount
5,931,532 A 8/1999 Kemmerer et al.
5,992,931 A 11/1999 LaPointe et al.
6,000,758 A 12/1999 Schaffner et al.
7,543,885 B2 6/2009 Pollard et al.
7,575,279 B2 8/2009 Robertson
7,631,937 B2 12/2009 Robertson
7,699,389 B2 4/2010 Robertson (Continued)

OTHER PUBLICATIONS

International Search Report for PCT/US2013/056948 mailed Nov. 12, 2013.

(Continued)

*Primary Examiner* — Philip Gabler
(74) *Attorney, Agent, or Firm* — Harness, Dickey & Pierce, P.L.C.

(57) ABSTRACT

A furniture member includes a frame, a slide member, first and second bars, an axle, and first and second leg members. The frame includes a chair portion movable relative to a base among nominal, reclined and lift positions. The slide member is connected to the motor and displaceable relative to the base. The first bar is connected to the slide member and the chair portion. The first bar moves the chair portion among the nominal, reclined and lift positions. The axle is mounted to the base portion. The leg members are attached to the axle and include fore and aft feet. The second bar is connected to the chair portion and slidably connected to the axle. The second bar rotates the axle in a first direction in response to movement into the reclined position and rotates the axle in a second direction in response to movement into the lift position.

31 Claims, 27 Drawing Sheets

(56) References Cited

U.S. PATENT DOCUMENTS

| | | | |
|---|---|---|---|
| 7,735,912 | B2 | 6/2010 | Robertson |
| 7,766,421 | B2 | 8/2010 | Lawson |
| 2005/0104430 | A1 | 5/2005 | Splane |

OTHER PUBLICATIONS

Written Opinion of the International Searching Authority for PCT/US2013/056948 mailed Nov. 12, 2013.

* cited by examiner

FURNITURE MEMBER AND POWER RECLINE AND LIFT MECHANISM

CROSS-REFERENCE TO RELATED APPLICATIONS

This application is a continuation-in-part of U.S. patent application Ser. No. 13/611,873 filed on Sep. 12, 2012. The entire disclosure of the above application is incorporated herein by reference.

FIELD

The present disclosure relates to a furniture member and power recline and lift mechanism.

BACKGROUND

This section provides background information related to the present disclosure and is not necessarily prior art.

Power lift chairs can provide a motor-operated transition from an occupant's seated position to a lift position which provides the occupant with approximately 50 percent or more of a transition from a seated position to a standing position. Such a feature may be particularly beneficial for occupants who have difficulty directly standing from a fully seated position.

Known power lift chair designs can impede placement of the occupant's feet in a position close to the center of gravity of the occupant and, therefore, require greater that necessary leg strength of the occupant to stand even when at a full lift position of the chair. In addition, known power lift chair designs have complicated operating mechanisms that are expensive to build and therefore result in a high cost of purchase. Further, known power lift chair designs do not provide for multiple chair positions or range of motion that maximize occupant choice of seating and/or leg rest positions.

SUMMARY

This section provides a general summary of the disclosure, and is not a comprehensive disclosure of its full scope or all of its features.

In one form, the present disclosure provides a furniture member that may include a frame assembly, a motor, a slide member, a first bar, an axle, first and second leg members and a second bar. The frame assembly may include a chair portion movable relative to a base portion among a nominal position, a reclined position and a lift position. The motor may be attached to the base portion. The slide member may be connected to the motor and displaceable relative to the base portion in first and second directions by selective operation of the motor. The first bar may be connected to the slide member and the chair portion. The first bar may move the chair portion among the nominal position, the reclined position and the lift position in response to operation of the motor. The axle may be rotatably mounted to the base portion. The first and second leg members may be attached to respective first and second ends of the axle. Each of the first and second leg members may include a fore foot and an aft foot. The second bar may be connected to the chair portion and slidably connected to the axle. The second bar may rotate the axle in a first direction in response to movement of the chair portion into the reclined position. The second bar may rotate the axle in a second direction in response to movement of the chair portion into the lift position.

In some embodiments, the fore feet of the first and second leg members extend through the base portion in the reclined position so that an aft portion of the base and fore feet of the first and second leg members are supporting a weight of the furniture member with a fore portion of the base portion spaced apart from a ground surface upon which the furniture member is situated.

In some embodiments, the aft feet of the first and second leg members extend through the base portion in the lift position so that the fore portion of the base and aft feet of the first and second leg members are supporting the weight of the furniture member with the aft portion of the base portion spaced apart from the ground surface.

In some embodiments, the first and second leg members are generally U-shaped members.

In some embodiments, the base portion includes a plurality of apertures through which the fore and aft feet of the first and second leg members are extendable.

In some embodiments, the furniture member includes a legrest mechanism including a legrest linkage and a legrest member that are moveable between an extended position and a retracted position independently of movement of the first and second bars.

In some embodiments, the legrest mechanism includes a legrest motor that drivingly engages the legrest linkage.

In some embodiments, the axle is rotatably supported by bearing blocks that are fixedly mounted to the base portion.

In some embodiments, the first and second leg members are fixedly attached to the axle by first and second brackets, respectively.

In some embodiments, the second bar includes an elongated slot that slidably receives a peg that is fixedly attached to the axle.

In some embodiments, the slide connected to the first bar has a range of motion that is longer than the elongated slot so that the peg slides along the elongated slot of the second bar for only a portion of the range of motion of the slide.

In some embodiments, continued motion of the slide in a rearward direction past a position of the slide corresponding to initial contact between the peg and a fore end of the elongated slot causes rotation of the axle and the first and second leg members in a first rotational direction relative to the base portion.

In some embodiments, continued motion of the slide in a forward direction past a position of the slide corresponding to initial contact between the peg and an aft end of the elongated slot causes rotation of the axle and the first and second leg members in a second rotational direction relative to the base portion.

In some embodiments, the furniture member can be a chair.

In some embodiments, the furniture member can be a sofa or a section of a sofa.

In some embodiments, an angle between a seatback of the chair portion and a seat bottom of the chair portion increases by a predetermined amount when the chair portion is moved from the nominal position to the lift position. The predetermined amount may be approximately five degrees, for example.

In another form, the present disclosure provides a furniture member that may include a base member, a chair frame, a mechanism, and first and second leg members. The base member may include fore and aft end portions. The chair frame may be movable relative to the base member among a nominal position, a reclined position and a lift position. The mechanism may move the chair frame relative to the base member among the nominal, reclined and lift positions. The first and second leg members may each have fore and aft feet movably mounted to the base member such that the fore feet extend through the base member in the reclined position and the aft feet extend through the base member in the lift position. The fore and aft end portions of the base may support a weight of the furniture member in the nominal position. The fore feet and the aft end portion may support the weight in the reclined position. The aft feet and the fore end portion may support the weight in the lift position.

In some embodiments, the mechanism includes a motor attached to the base member, a slide member connected to the motor, and a first bar connected to the slide member and the chair frame.

In some embodiments, the furniture member includes an axle rotatably mounted to the base member; and a second bar connected to the chair frame and slidably connected to the axle. The second bar may rotate the axle in a first direction in response to movement of the chair frame into the reclined position and rotate the axle in a second direction in response to movement of the chair frame into the lift position.

In some embodiments, the second bar includes an elongated slot that slidably receives a peg that is fixedly attached to the axle.

In some embodiments, the slide connected to the first bar has a range of motion that is longer than the elongated slot so that the peg slides along the elongated slot of the second bar for only a portion of the range of motion of the slide member.

In some embodiments, continued motion of the slide member in a rearward direction past a position of the slide member corresponding to initial contact between the peg and a fore end of the elongated slot causes rotation of the axle and the first and second leg members in a first rotational direction relative to the base member.

In some embodiments, continued motion of the slide member in a forward direction past a position of the slide member corresponding to initial contact between the peg and an aft end of the elongated slot causes rotation of the axle and the first and second leg members in a second rotational direction relative to the base member.

In some embodiments, the axle is rotatably supported by bearing blocks that are fixedly mounted to the base member.

In some embodiments, the first and second leg members are fixedly attached to the axle by first and second brackets, respectively.

In some embodiments, the base member includes a plurality of apertures through which the fore and aft feet of the first and second leg members are extendable.

In some embodiments, the furniture member includes a legrest mechanism including a legrest linkage and a legrest member that are moveable between an extended position and a retracted position independently of movement of the first and second leg members.

In some embodiments, the legrest mechanism includes a legrest motor that drivingly engages the legrest linkage.

In some embodiments, the first and second leg members are generally U-shaped members.

In some embodiments, the furniture member can be a chair.

In some embodiments, the furniture member can be a sofa or a section of a sofa.

In some embodiments, an angle between a seatback of the chair frame and a seat bottom of the chair frame increases by a predetermined amount when the chair frame is moved from the nominal position to the lift position. The predetermined amount may be approximately five degrees, for example.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
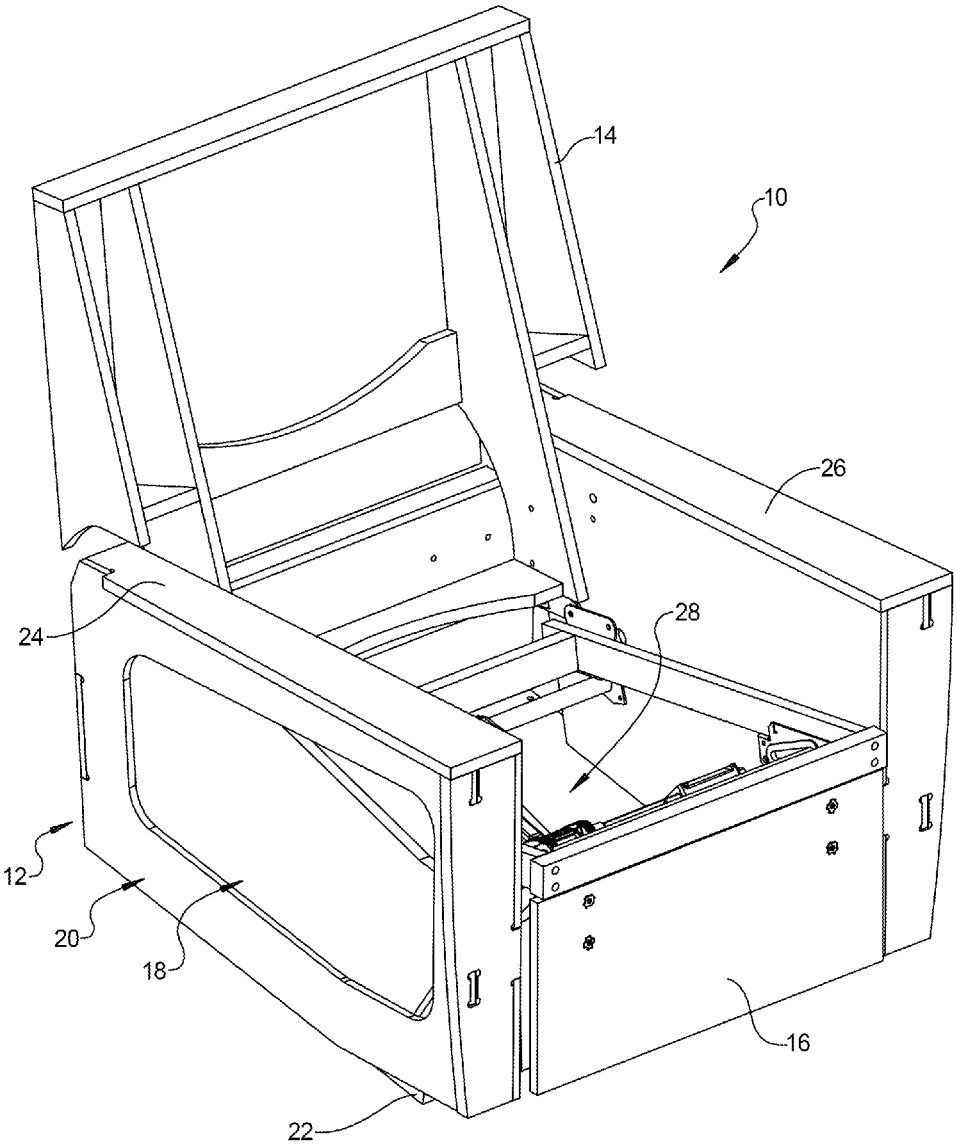
FIG. 1 is a front right perspective view of a furniture member having a power lift mechanism shown in a nominal seating position.

Referring to FIG. 1, a lift chair 10 includes a rotatable frame assembly 12 having a seat back assembly 14 rotatably connected to frame assembly 12, and a leg rest member 16 connected to and extendable/retractable with respect to frame assembly 12. The frame assembly 12 includes a base portion 18 which is positioned interior to and rotatable with respect to a chair portion 20. For clarity, lift chair 10 is not shown with seat support springs, padding, or upholstery which are commonly applied to lift chairs as known in the art. The lift chair 10 is supported on a floor or planar surface using a square or rectangular shaped base platform 22 which according to several embodiments is included with base portion 18. The chair portion 20 further includes each of a first arm rest portion 24, corresponding to a right side of an occupant seated in lift chair 10, and a second arm rest portion 26, corresponding to a left side of the seated occupant. Lift chair 10 also includes several components which are movably displaced using a mechanism 28. Mechanism 28 independently or in combination controls: forward and rearward rotational displacement of seat back assembly 14; extension/retraction of the leg rest member 16 between a stowed position shown to an outward extended position, which is shown and described in reference to FIGS. 9 and 10; and rotation of the chair portion 20 upwardly and downwardly with respect to the base portion 18 to provide multiple occupant seating positions and a full lift position.

Referring to FIG. 2 and again to FIG. 1, lift chair 10 is shown following an upward/forward rotation from the nominal seating position of FIG. 1 to a maximum lift position which accommodates user exit or entrance from/to the lift chair 10. To rotate lift chair 10 from the nominal seating position defined as a seat back fully upright and leg rest stowed position (shown in FIG. 1) to the lift position (shown in FIG. 2), a lift mechanism portion 30 of mechanism 28 is actuated by the occupant, causing lift and rotation of chair portion 20 with respect to a frame rotational axis 32 which rotates chair portion 20 in a lift rotational direction "A". In the full lift position shown, the seat back assembly 14 is positioned in the fully upright position and leg rest member 16 is positioned in its stowed position. The mechanism 28 further includes a leg rest mechanism portion 34 which will be described in greater detail in reference to FIG. 5, which is not operational during the rotation of chair portion 20 to the full lift position. As also visible in FIG. 2, the chair portion 20 further includes a first inner arm rest member 36 positioned to the occupant's right hand side and a second inner arm rest member 38 positioned to the occupant's left hand side, which are nested between a first base frame member 40 and a second base frame member 42.

Referring to FIG. 3 and again to FIG. 1, components of the lift mechanism portion 30 of mechanism 28 are positioned in a cavity defined between the first and second base frame members 40, 42. The first base frame member 40 is positioned proximate to a base platform first edge 44 of base platform 22, and second base frame member 42 is positioned proximate to a base platform second edge 46 of base platform 22. Each of the first and second base frame members 40, 42 are oriented parallel with respect to each other and substantially perpendicular to base platform 22. A third base frame member 48, defining a rear facing wall of base portion 18, is positioned proximate to a base platform third edge 50 of base platform 22. A plurality of feet 51 are adjustably connected to base platform 22 at each of a plurality of feet positioning apertures 52. Feet 51 allow for ensuring contact and equal support of the four corners of base platform 22.

Each of the first and second base frame members 40, 42 are provided with an intersecting corner 53 where a frame member forward edge 54 of each of the first and second base frame members 40, 42 intersects with base platform 22. The intersecting corner 53 of each of the first and second base frame members 40, 42 is spatially and rearwardly positioned with respect to a base platform forward edge 55 of base platform 22. According to several aspects, first base frame member 40 includes a first receiving face 56 which is oriented parallel with respect to an upper face 58 of base platform 22. The first receiving face 56 is positioned proximate to the frame member forward edge 54 of first base frame member 40. A second receiving face 60 is similarly provided with second base frame member 42, which is oriented parallel with respect to upper face 58 and co-planar with respect to first receiving face 56. A first receiving slot 62, having a generally U-shape, is created downwardly with respect to the first receiving face 56. The first receiving slot 62 receives a first U-shaped journal 64 which is sized to be slidably received in first receiving slot 62 in a downward direction. The first U-shaped journal 64 is integrally included with a first connection member 66 which can be combined as a unitary molded plastic component. Once the first U-shaped journal 64 is received in the first receiving slot 62, connection member fasteners 68 are inserted from the outer side or face of first base frame member 40 and are received in threaded apertures of first connection member 66 to fix the location of first connection member 66.

Figure 6:
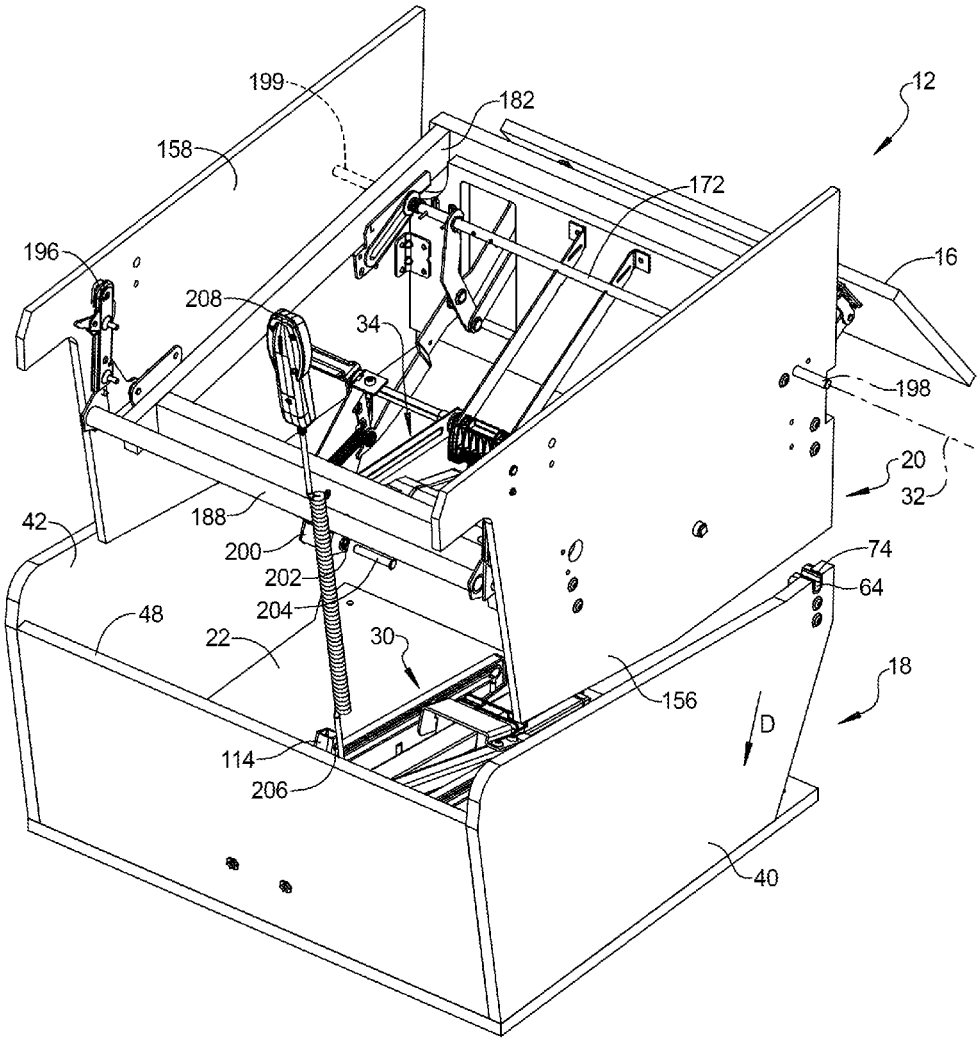
FIG. 6 is a right rear perspective view of the base and chair portions of FIGS. 4 and 5 during assembly.

A second U-shaped journal 70 of a second connection member 72, defining either a duplicate of or a mirror image of first connection member 66, is similarly positioned in a U-shaped second receiving slot created in second receiving face 60 of second base frame member 42. Second connection member 72 is shown in its installed position. In the installed position of both first and second connection members 66, 72, an upper edge 74 of both members is positioned substantially flush with or slightly above the first or second receiving face 56, 60. In addition, the upper edge 74 of both first U-shaped journal 64 and second U-shaped journal 70 may extend partially into the U-shaped slot defined by the U-shaped journal 64, 70. The purpose for this extension will be better described in reference to FIG. 6.

The frame member forward edge 54 of each of the first and second base frame members 40, 42 defines an acute angle $\alpha$ with respect to a plane defined by upper face 58 of base platform 22. The purpose of angle $\alpha$ will be better described in reference to FIG. 16. It is noted that intersecting corner 53 is recessed rearwardly with respect to base platform forward edge 55 to create angle $\alpha$.

With continuing reference to FIG. 3 and again to FIG. 1, lift mechanism portion 30 includes a lift motor 76 which according to several aspects is a direct current (DC) motor. A mounting bracket 78 is connected to a forward directed face 80 of third base frame member 48 and also to upper face 58 of base platform 22. Mounting bracket 78 includes coaxial through apertures 82, only one of which is clearly visible in FIG. 3, which slidably receive an assembly mount pin 84 to connect an assembly, including lift motor 76 and a gear housing 86 directly connected to lift motor 76, which includes internal gears (not shown) which drive and are directly connected to an internal worm gear (not shown) of a worm drive assembly 88. It is noted that throughout this disclosure the description of a "worm drive" device or gear is not limiting and can be replaced by other drive devices or gears as are known in the art.

Operation of lift motor 76 slidably displaces a worm gear slide 90 which is slidably disposed on and displaced during operation of the worm gear of worm drive assembly 88 in each of a slide lifting direction "B" or oppositely in a slide returning direction "C". An assembly end 92 of worm drive assembly 88 is connected to upper face 58 of base platform 22 using an assembly end bracket 94. Positioned on opposite sides of worm drive assembly 88 are triangularly shaped first and second guide members 96, 98. According to several aspects, first and second guide members 96, 98 are molded plastic components; however, alternate materials can also be used. First guide member 96 includes a first elongated slot 100, and second guide member 98 includes a second elongated slot 102, both located proximate to an upper wall or edge 103, 103' of first and second guide members 96, 98. Elongated slots 100, 102 are oriented substantially in parallel axial alignment with each other in the installed positions of the first and second guide members 96, 98. Each of the first and second guide members 96, 98 also includes a low elevation end 104 oriented toward the forward or front facing portion of base portion 18 and a high elevation end 106 oriented toward third base frame member 48 or a rear facing end of base portion 18. The elongated slots 100, 102 therefore have a continuous rearward to frontward downward pitch or angle with respect to upper face 58. Each of the first and second guide members 96, 98 also includes a planar support face 108 which rests on and is fastened to the upper face 58 of base platform 22.

Lift mechanism portion 30 further includes a rectangular and hollow metal lift bar or tube 110. The lift bar 110 may be a generally L-shaped bar including a substantially straight first tube portion 112 and a second tube portion 114 which is angularly oriented with respect to first tube portion 112. The lift bar 110 is connected to, and therefore displaces during the sliding motion of worm gear slide 90. A combined weight of a substantial portion of chair portion 20 plus a substantial portion of a weight of the occupant are distributed by lift bar 110 to worm gear slide 90 and thereby to each of the first and second guide members 96, 98 such that bending does not occur within the length of worm drive assembly 88.

To provide a sliding connection between the worm gear slide 90 and each of the first and second guide members 96, 98, two shoulder bolts are provided. A first shoulder bolt 116 includes a bolt head 118, a bolt sleeve 120, and a bolt threaded shank 122 positioned opposite to bolt head 118. During assembly, the bolt threaded shank 122 and bolt sleeve 120 of first shoulder bolt 116 are disposed through elongated slot 100 of first guide member 96. A tube connecting end 124 of lift bar 110 is positioned between a first inside face 126 of first guide member 96 and a first slide face 128 of worm gear slide 90. After the bolt threaded shank 122 and bolt sleeve 120 of first shoulder bolt 116 extend through elongated slot 100, they are slidably disposed through a tube through aperture 130 created in the tube connecting end 124. Bolt threaded shank 122 extends out of tube through aperture 130 and is threadably engaged in a first threaded bore 132 created in the first slide face 128 of worm gear slide 90. Different portions of bolt sleeve 120 are slidably received in elongated slot 100 and rotatably received in the tube through aperture 130, therefore allowing sliding motion of worm gear slide 90 as well as rotation of lift bar 110 with respect to a central axis of first shoulder bolt 116. The sliding contact of first shoulder bolt 116 with walls of first elongated slot 100 therefore distributes half the weight received at worm gear slide 90 to first guide member 96 and base platform 22 at any sliding position of worm gear slide 90.

The lift bar 110 is also connected to second guide member 98 in the following manner. An offset flange 134 is fastenably engaged to the tube connecting end 124 using bracket fasteners 136. The offset flange 134 is integrally connected to a connection bracket 138. Connection bracket 138 is substantially planar such that connection bracket 138 can rest on a plurality of ribs defining a slide surface 140 of worm gear slide 90. A transverse flange 142 is oriented transverse to and integrally connected to connection bracket 138, and contacts a second slide face 144 of worm gear slide 90 which is oriented parallel to, but oppositely facing with respect to first slide face 128. A transverse flange aperture 146 of transverse flange 142 is positioned proximate to a bushing 148 that is disposed between transverse flange 142 and a second inside face 150 of second guide member 98. Bushing 148 has a length which corresponds approximately with a width of lift bar 110, thereby spacing first and second guide members 96, 98 substantially equally about and with respect to worm drive assembly 88. A bushing bore 152 of bushing 148 is coaxially aligned with transverse flange aperture 146 and a second shoulder bolt 154 is assembled similar to first shoulder bolt 116 by extending second shoulder bolt 154 through the elongated slot 102, the bushing bore 152, the transverse flange aperture 146, and a threaded aperture (not visible in this view) created in the second slide face 144 of worm gear slide 90. The second shoulder bolt 154 therefore similarly provides sliding support for half the weight distributed through worm gear slide 90 to second guide member 98 and thereby to base platform 22.

Figure 2:
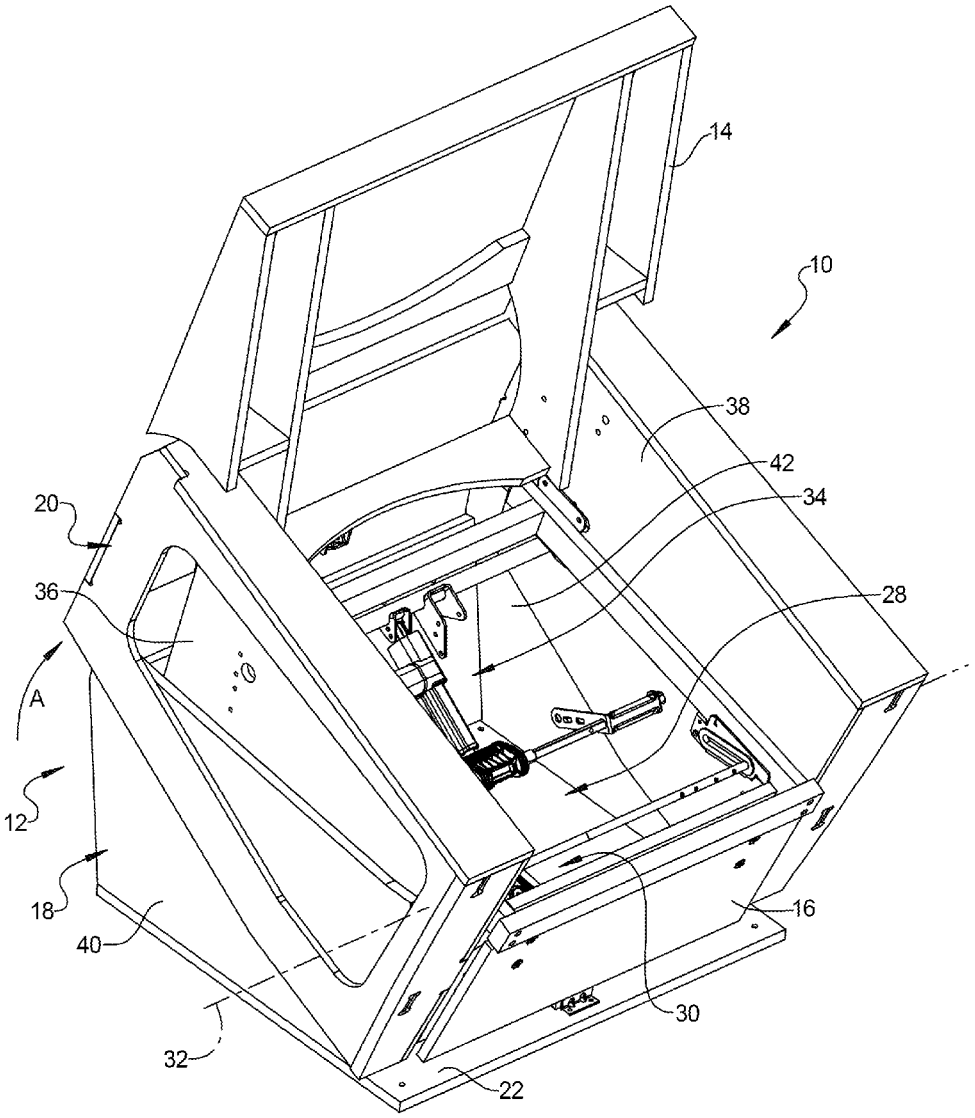
FIG. 2 is the furniture member of FIG. 1 shown in a maximum lift position.
Figure 3:
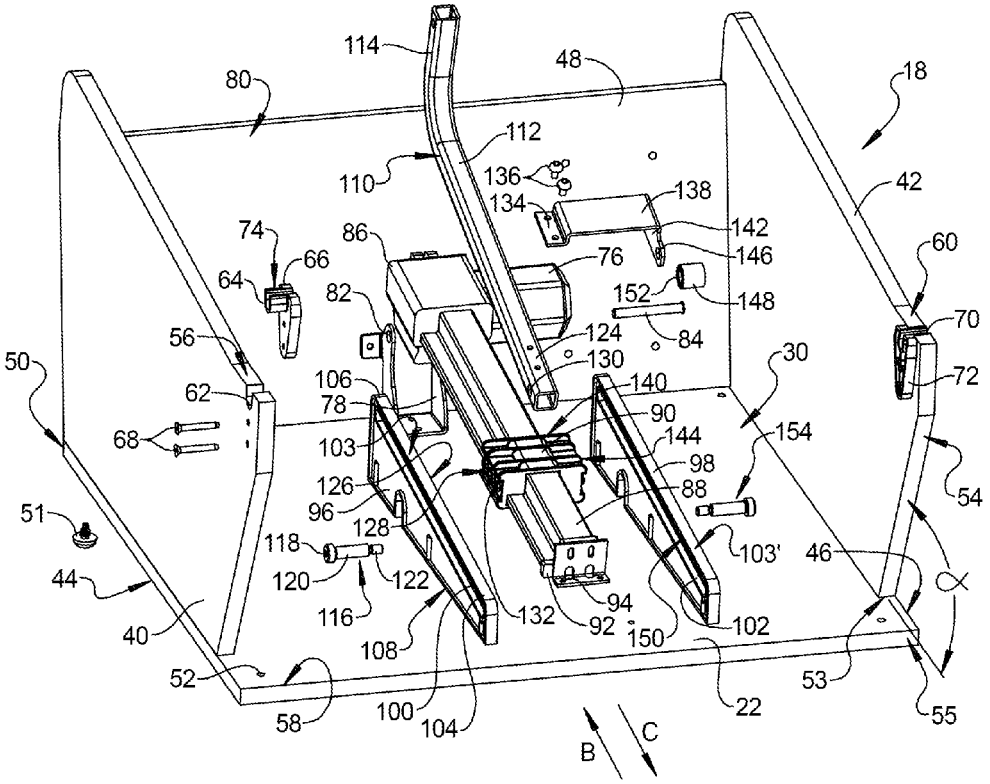
FIG. 3 is a front left perspective view of a base portion of the furniture member of FIG. 1 showing the power lift mechanism in an exploded view.

Referring to FIG. 4 and again to FIGS. 1-3, base portion 18 is shown following the completed assembly of lift mechanism portion 30. In the assembled condition shown, the worm gear slide 90 is positioned in a neutral or nominal position which provides a basic seating position for the occupant of lift chair 10. By subsequent operation of lift motor 76, gear housing 86 and worm drive assembly 88, worm gear slide 90 can be slidably disposed in the slide lifting direction "B" to rearwardly and upwardly displace lift bar 110, establishing the lift chair full lift position shown with respect to FIG. 2. The occupant's weight, transferred via lift bar 110 to worm gear slide 90, is distributed to each of the first and second guide members 96, 98 by the first and second shoulder bolts 116, 154. In the nominal position of worm gear slide 90, the first and second shoulder bolts 116, 154 are positioned approximately two thirds along a length of elongated slots 100, 102 looking forward with respect to lift motor 76. Also, in the nominal position of worm gear slide 90, the connection bracket 138 lays substantially flat with respect to worm gear slide 90. In the completed assembly position of base portion 18, the first and second U-shaped journals 64, 70 are fixed in place, and base portion 18 is therefore ready to receive chair portion 20 as will be described in reference to FIG. 6.

Referring to FIG. 5 and again to FIG. 1, the chair portion 20 is assembled as follows. First and second chair frame members 156, 158 are positioned substantially parallel with respect to each other. A chair frame structural tube 160 is fixed to rearward ends of each of the first and second chair frame members 156, 158 to provide a predetermined frame spacing. A chair frame front connecting member 162 connects forward ends of the first and second chair frame members 156, 158. The leg rest mechanism portion 34 is positioned between and supported by the chair frame structural tube 160 and the chair frame front connecting member 162.

The leg rest mechanism portion 34 includes a leg rest drive motor 164 which according to several aspects is a DC motor. The leg rest drive motor 164 is connected to a drive connecting member 166 which is used to rotate a drive rod 168 using a drive rod connecting member 170. A support shaft 172 is positioned in parallel with drive rod 168 and includes portions which extend outwardly via apertures 173, 173' created in each of the first and second chair frame members 156, 158. The extending portions will be described in better detail in reference to FIG. 6. First and second pantograph linkage sets 174, 176 are each connected to the drive rod 168 and the support shaft 172. Operation of the leg rest drive motor 164 causes extension of the drive rod connecting member 170 which axially rotates drive rod 168. Rotation of drive rod 168 acts to extend or retract each of the first and second pantograph linkage sets 174, 176. The first pantograph linkage set 174 extends through a first clearance opening 178 created in chair frame front connecting member 162. Similarly, the second pantograph linkage set 176 extends through a second clearance opening 180 of chair frame front connecting member 162. Each of the first and second pantograph linkage sets 174, 176 are connected to the leg rest member 16. Extension or retraction of the first and second pantograph linkage sets 174, 176 therefore extends or retracts the leg rest member 16.

Figure 5:
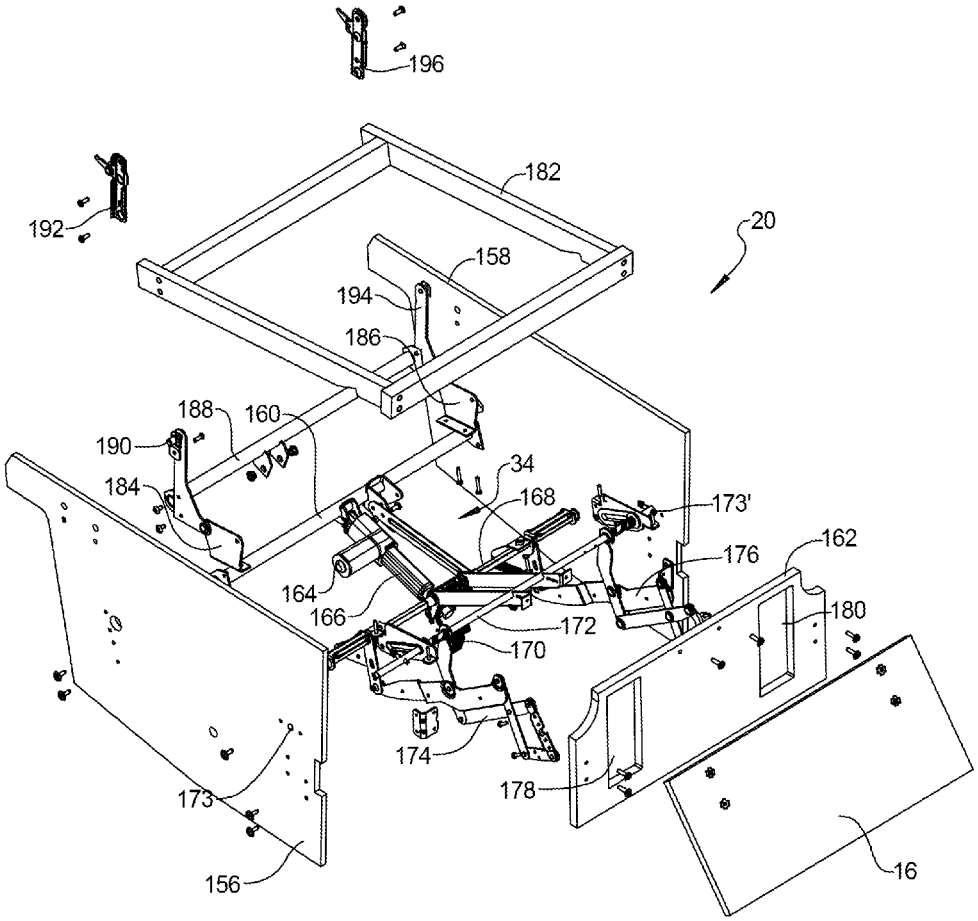
FIG. 5 is a front right perspective exploded assembly view of a chair portion of the furniture member of FIG. 1.

With continuing reference to FIG. 5, chair portion 20 further includes a seat frame 182 which is supported in part on first and second swing assemblies 184, 186 which are rotatably connected to a tube assembly 188. A first rear swing assembly 190 is also connected to tube assembly 188 and a first back bracket assembly 192 is connected to first rear swing assembly 190. Similarly, a second rear swing assembly 194 is also connected to tube assembly 188 and a second back bracket assembly 196 is connected to the second rear swing assembly 194. The first and second back bracket assemblies 192, 196 are used to releasably connect the seat back assembly 14. Rotation of the tube assembly 188 with respect to first and second rear swing assemblies 190, 194 displaces the first and second swing assemblies 184, 186, which displace the seat frame 182 either forwardly or rearwardly.

Referring to FIG. 6 and again to FIGS. 1-5, frame assembly 12 is assembled by inserting the assembled chair portion 20 into the assembled base portion 18 by loading the chair portion 20 in a downward installation direction "D" until a first shaft extension portion 198 and a second shaft extension portion 199 (shown in phantom in FIG. 6), which are integral, extending portions of support shaft 172, are received in the individual first and second U-shaped journals 64, 70 (only first U-shaped journal 64 is clearly visible in this view). By downwardly pressing the first and second shaft extension portions 198, 199 past the upper edges 74 which extend partially into the first and second U-shaped journals 64, 70 providing a clearance less than a diameter of the first and second shaft extension portions 198, 199, the first and second shaft extension portions 198, 199 will snap into position within first and second U-shaped journals 64, 70, defining a frictional snap fit, and thereafter the upper edge 74 resists removal of the shaft extension portions 198, 199. A material of the U-shaped journals 64, 70 is selected to provide a low coefficient of friction and, as such, can be a polyamide or a polytetraflouroethylene material or similar polymeric material to provide minimal resistance to rotation of chair portion 20 with respect to base portion 18.

To assemble the chair portion 20 to the base portion 18, after the chair portion 20 is received within base portion 18, the first shaft extension portions 198, 199 are individually and sequentially (in any order) snapped in the individual first and second U-shaped journals 64, 70. The second tube portion 114 of lift bar 110 is then positioned in a clevis 200 fixed to the tube assembly 188. A clevis through aperture of an insulating bushing 202 receives a tube mounting pin 204 which is also extended through a second tube aperture 206 created in second tube portion 114 such that second tube portion 114 is rotatably connected to the clevis 200. Tube mounting pin 204 can be retained after insertion using a standard hairpin clip (not shown). Although additional structural members can be used to connect first and second chair frame members 156, 158, the third base frame member 48 of base portion 18 substantially provides a rear wall when the chair portion 20 is received in base portion 18. A motor control fob 208 is then connected to the mechanism 28 for selective operation by the occupant in directing operation of either or both the lift mechanism portion 30 and/or leg rest mechanism portion 34. At this time, the leg rest member 16 is free to extend in a forward direction by operation of the leg rest mechanism portion 34.

Referring to FIG. 7 and again to FIG. 1, lift chair 10 can be moved from the nominal position shown in FIG. 1 to a forward lift position shown in FIG. 7 by operation of the lift mechanism portion 30 which causes a forward rotation of chair portion 20 with respect to frame rotational axis 32. Each of the first and second arm rest portions 24, 26 includes an arm rest outer frame 210 having a first frame lower face 212 at a rearward end of arm rest outer frame 210 and a second frame lower face 214 positioned toward a forward end of arm rest outer frame 210. The first frame lower face 212 is oriented at an angle with respect to second frame lower face 214. As the chair portion 20 is rotated in the lift rotational direction "A", the second frame lower face 214 is brought into parallel alignment with base platform 22, and the first frame lower face 212 is raised with respect to the base platform third edge 50. In this forward lift position, the seat back assembly 14 is in its upright position, and the leg rest member 16 is in its stowed position.

Figure 7:
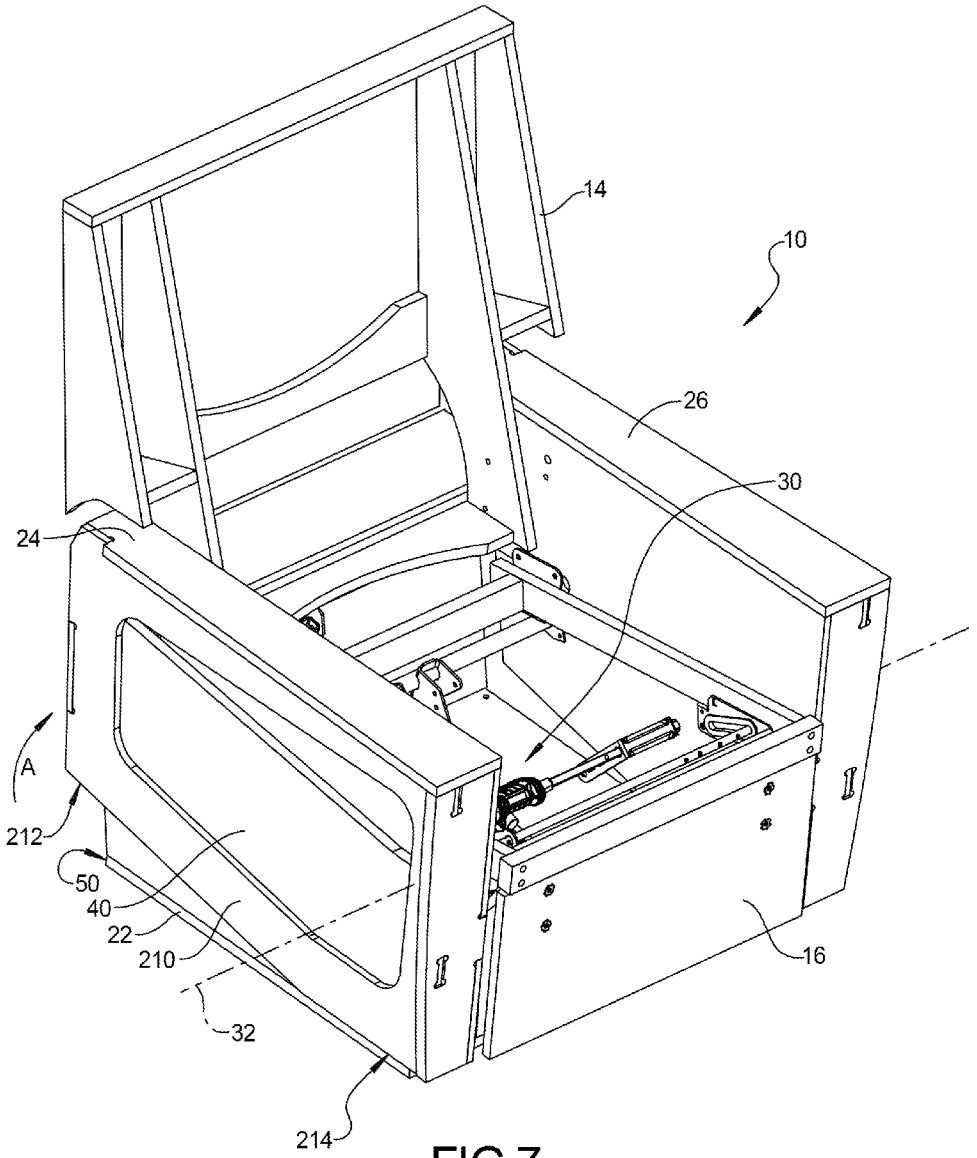
FIG. 7 is a front right perspective view of the furniture member of FIG. 1 in a forward lift position.

Referring to FIG. 8 and again to FIGS. 1 and 7, lift chair 10 can also be positioned in a rearward tilt position by operation of lift mechanism portion 30. As chair portion 20 is rotated in a chair downward rotational direction "E" with respect to frame rotational axis 32, the first frame lower face 212 is brought into parallel alignment with base platform 22, and the second frame lower face 214 is raised with respect to base platform 22. By further operation of lift mechanism portion 30, seat back assembly 14 is rotated in a seat back reclining direction "F", which directly results in a forward displacement of the seat frame 182 in a seat frame extending direction "G". The forward displacement of seat frame 182 is caused by rotation/displacement of the tube assembly 188 during operation of lift mechanism portion 30. At this time, the leg rest member 16 is still in its stowed position. Operation of the leg rest mechanism portion 34 is therefore not required to reach the lift chair rearward tilt and seat back assembly rearward reclined positions shown.

Referring to FIG. 9 and again to FIGS. 1, 3, and 7-8, from the nominal position of lift chair shown in FIG. 1 with the seat back assembly 14 in the fully upright position, the leg rest member 16 can be extended by operation of leg rest mechanism portion 34. Operation of leg rest drive motor 164 causes extension of the first and second pantograph linkage sets 174, 176 (only first pantograph linkage set 174 is shown for clarity). The leg rest member 16 can be extended without repositioning seat frame 182.

Figure 9:
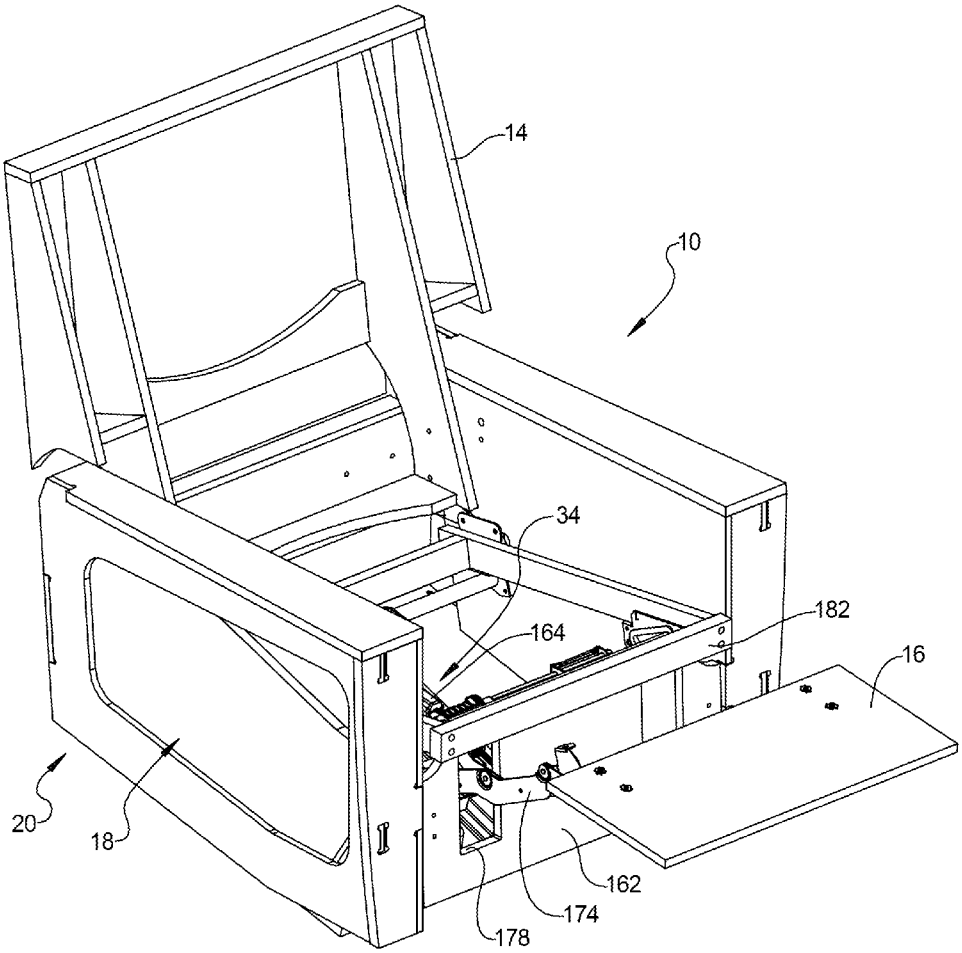
FIG. 9 is a front right perspective view of the furniture member of FIG. 1 in a leg rest extended position.
Figure 10:
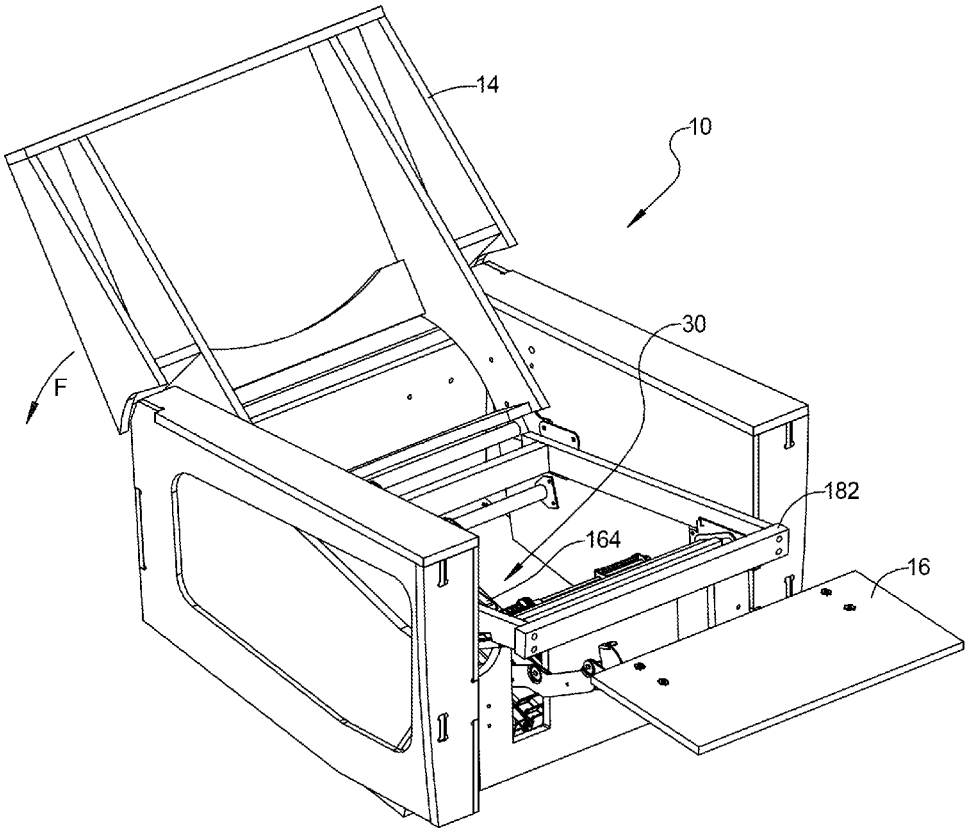
FIG. 10 is a front right perspective view of the furniture member of FIG. 1 in a seatback rotated and leg rest extended position.

Referring to FIG. 10 and again to FIG. 9, with the leg rest member 16 in the fully extended position, additional operation of lift mechanism portion 30 can be used to rotate the seat back assembly 14 from the fully upright to the seat back reclined position in the seat back reclining direction "F". In this position, seat back assembly 14 is fully rotated in the seat back reclining direction "F", the seat frame 182 is extended forwardly, and leg rest member 16 is fully extended.

Figure 11:
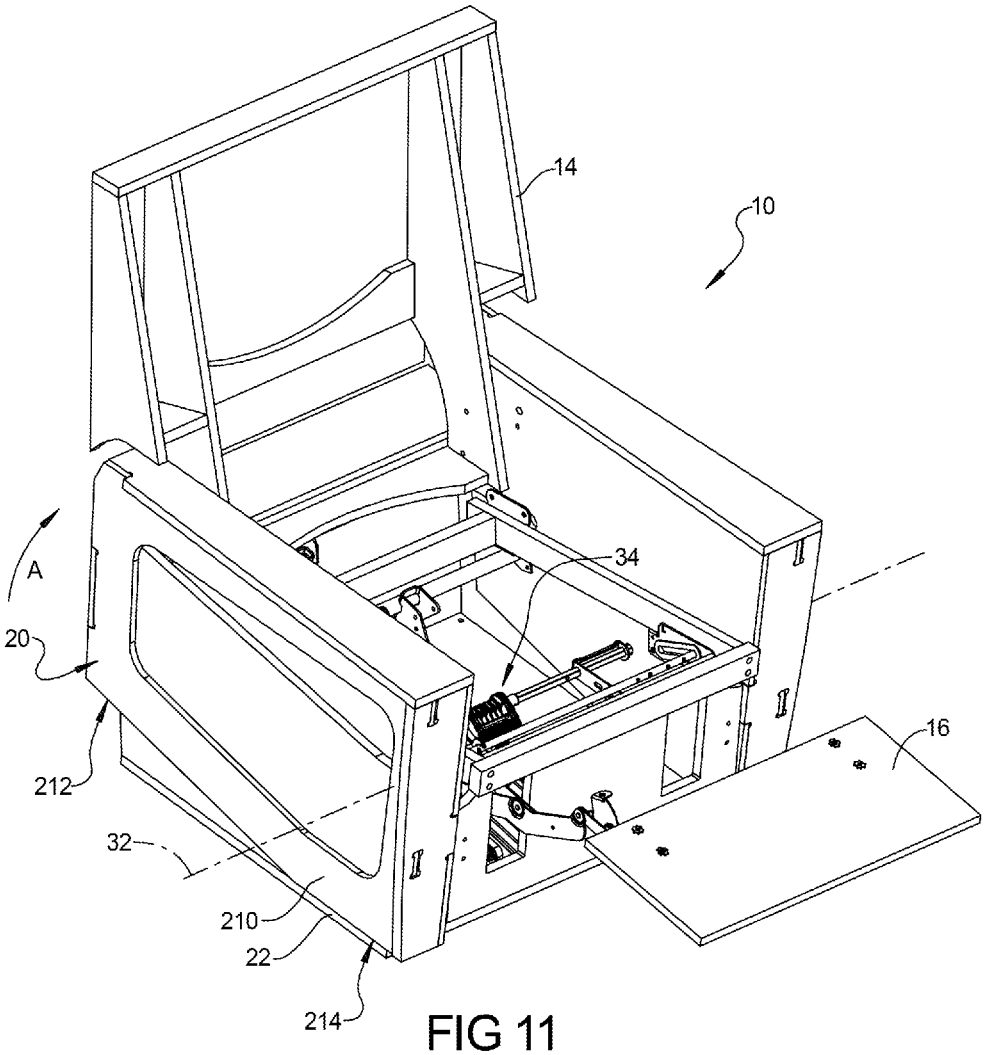
FIG. 11 is a front right perspective view of the furniture member of FIG. 9 in the leg rest extended and further in a forward lift position.

Referring to FIG. 11 and again to FIG. 7, with lift chair 10 already positioned in the forward lift position, the leg rest member 16 can be extended by operation of leg rest mechanism portion 34 either before or after rotation of chair portion 20 in the lift rotational direction "A" to the forward lift position. Again, in the forward lift position, the second frame lower face 214 of arm rest outer frames 210 are oriented substantially parallel or in direct contact with base platform 22, and the first frame lower face 212 is elevated with respect to base platform 22. From this position, either the chair portion 20 can be returned to the nominal position shown in FIG. 1 before the return of leg rest member 16 to the stowed position, or leg rest member 16 can be returned to the stowed position before chair portion 20 is returned to the nominal position.

Figure 12:
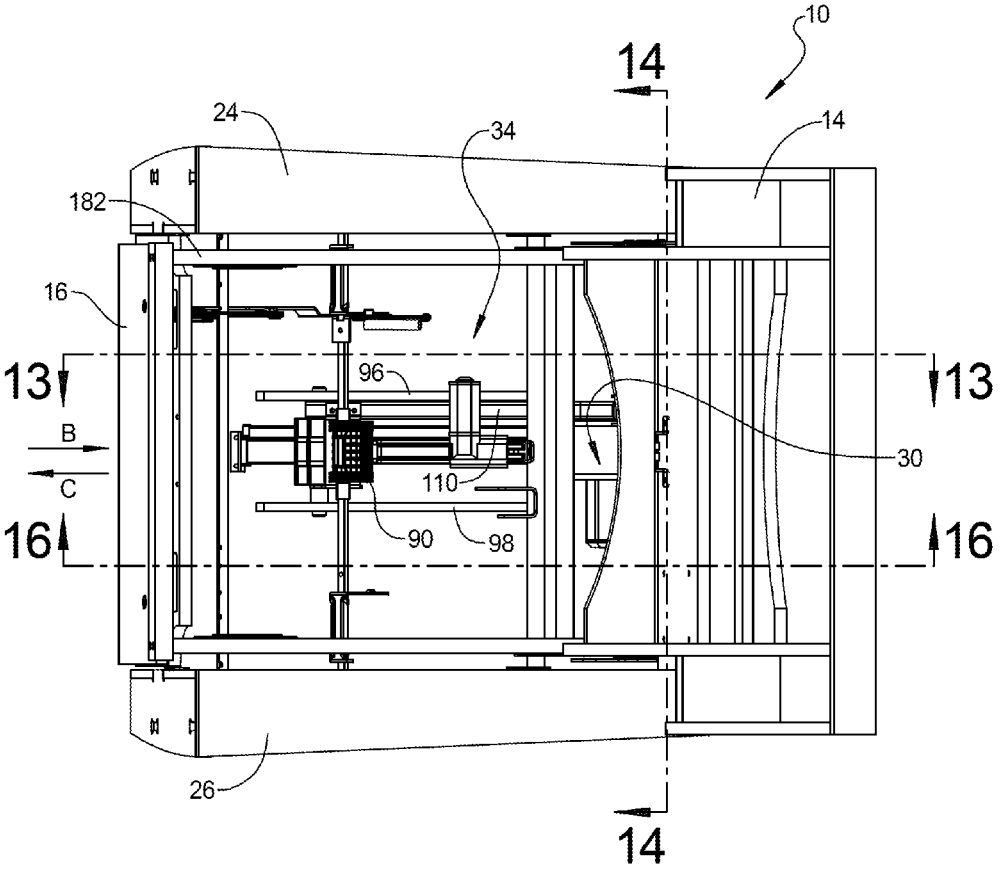
FIG. 12 is a top plan view of the furniture member of FIG. 1.

Referring to FIG. 12 and again to FIGS. 1 and 3, in the lift chair nominal position, the occupant seated on seat frame 182 has his or her weight distributed substantially onto worm gear slide 90 and thereby to each of the first and second guide members 96, 98. During operation of lift mechanism portion 30 in either of the slide lifting direction "B" or slide returning direction "C", the weight of the occupant remains substantially supported over worm gear slide 90 by distribution of the weight via lift bar 110.

Referring to FIG. 13 and again to FIGS. 1, 3, 5 and 12, in the lift chair nominal position with the seat back assembly 14 in the fully upright position and the leg rest member 16 in the stowed position, a chair frame rear wall/connecting member 216 of chair portion 20 extends below and rearwardly of third base frame member 48. A frame member lower end 218 of chair frame rear connecting member 216 is positioned substantially below an upper end 220 of the third base frame member 48. Also, as previously noted, in the nominal lift chair seating position the first shoulder bolt 116 (and second shoulder bolt 154, not visible in this view) is positioned substantially two thirds of the length of elongated slot 100 with respect to a rear-to-front orientation of elongated slot 100. The chair portion defines a four-sided wood structure, including: the first and second chair frame members 156, 158 oriented parallel to each other; the rear wall member 216 connected to and oriented perpendicular to the first and second chair frame members 156, 158; and the front wall member 162 connected to and oriented perpendicular to the first and second chair frame members 156, 158. The base portion 18 also defines a four-sided wood structure, including: the first and second base frame members 40, 42 oriented parallel to each other; the rectangular shaped base platform 22 oriented perpendicular to the first and second base frame members 40, 42; and the third base frame member 48 defining the rear facing wall of the base portion 18.

Figure 13:
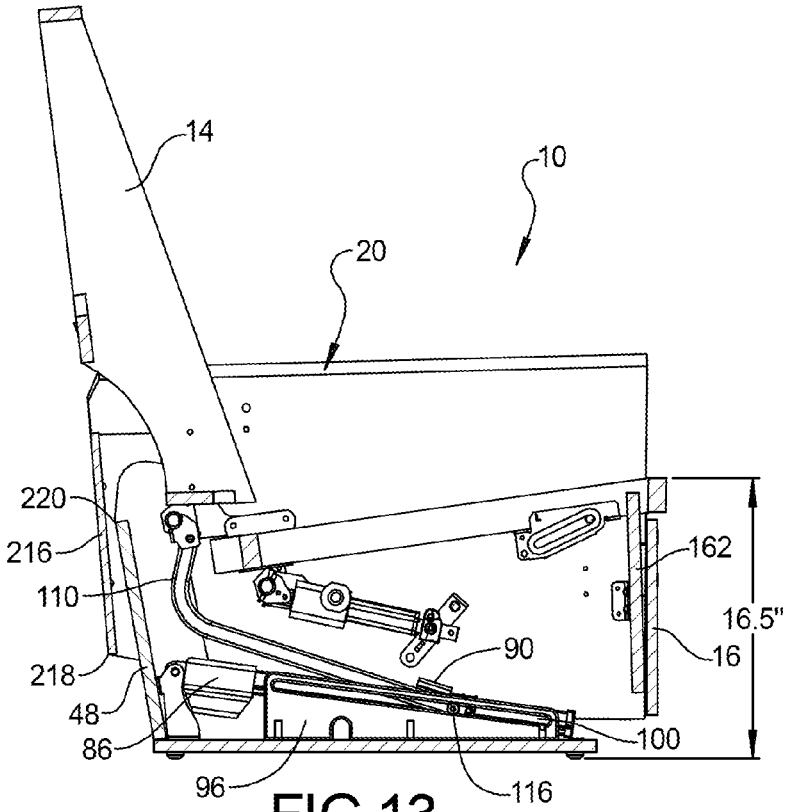
FIG. 13 is a cross sectional right side elevational view taken at section 13 of FIG. 12.
Figure 14:
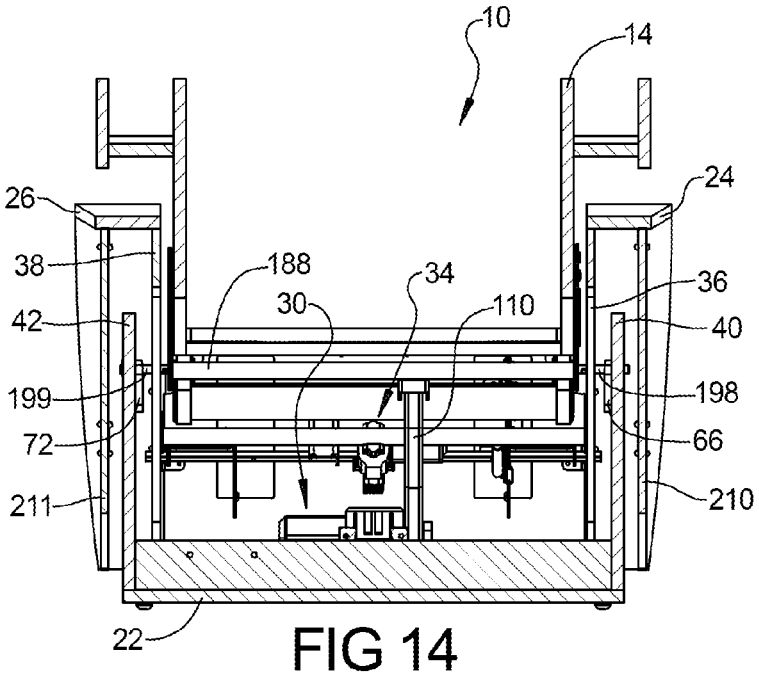
FIG. 14 is a cross sectional rear elevational view taken at section 14 of FIG. 12.

Referring to FIG. 14 and again to FIG. 13, a first portion of the weight of the occupant of lift chair 10 is partially distributed by the first and second shaft extension portions 198, 199 of support shaft 172 to each of the first and second base frame members 40, 42. A second portion of the occupant weight is distributed, as previously described herein, via tube assembly 188 and lift bar 110, to the components of lift mechanism portion 30 and thereby to base platform 22. As evident in FIG. 14, the first base frame member 40 is positioned in a cavity between first inner arm rest member 36 and arm rest outer frame 210 of first arm rest portion 24. Similarly, the second base frame member 42 is positioned in a cavity between second inner arm rest member 38 and an arm rest outer frame 211 (similar to arm rest outer frame 210) of second arm rest portion 26.

Referring to FIG. 15 and again to FIG. 2, when lift chair 10 is positioned at the maximum lift position by rotation of chair portion 20 about frame rotational axis 32, a lower end 222 of leg rest member 16 is still provided with clearance to base platform 22. It is noted again that the full lift position for lift chair 10 is achieved only with leg rest member 16 in the fully stowed position.

Figure 15:
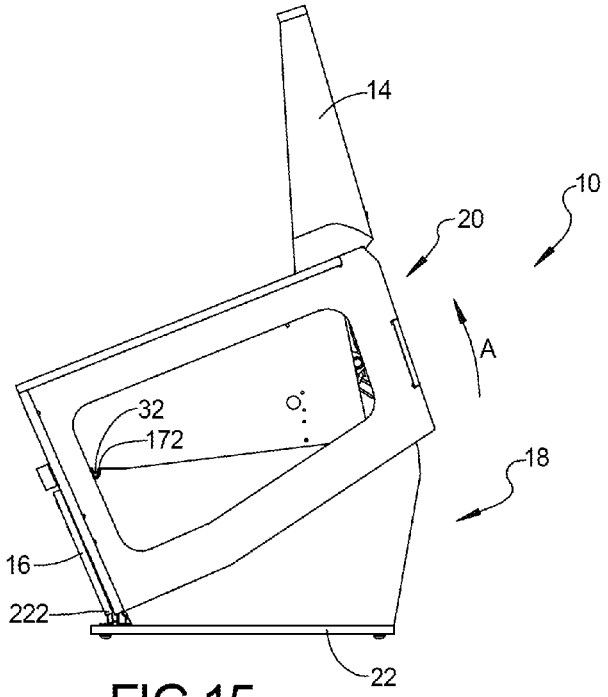
FIG. 15 is a left side elevational view of the furniture member of FIG. 2.

Referring to FIG. 16 and again to FIGS. 3 and 15, the orientation of the frame member forward edge 54 of both the first and second base frame members 40, 42 at angle $\alpha$ and the rearward positioning of the intersecting corner 53 with respect to frame member forward edge 54 provides additional clearance for the occupant's feet to be moved rearward to a position which is closer to the center of gravity of the occupant to aid in standing up from the lift chair full lift position. At the full lift position, second shoulder bolt 154 is positioned at a fully rearward end of elongated slot 102 and can be in direct contact with a slot rear end wall 224 of elongated slot 102. The first shoulder bolt 116 (not visible in this view) is similarly positioned with respect to first elongated slot 100. The lift bar 110 is therefore providing maximum extension height at clevis 200. At the maximum extension height, a vertical plane 226 defined at a forward edge 228 of seat frame 182 is oriented perpendicular with respect to a floor surface 230. The spacing between vertical plane 226 and base platform forward edge 55 provides additional space for the feet of the occupant to be positioned rearward of vertical plane 226 and therefore closer to a center of gravity of the occupant than known lift chairs. This enhances the ability of the occupant to stand and exit lift chair 10.

Figure 4:
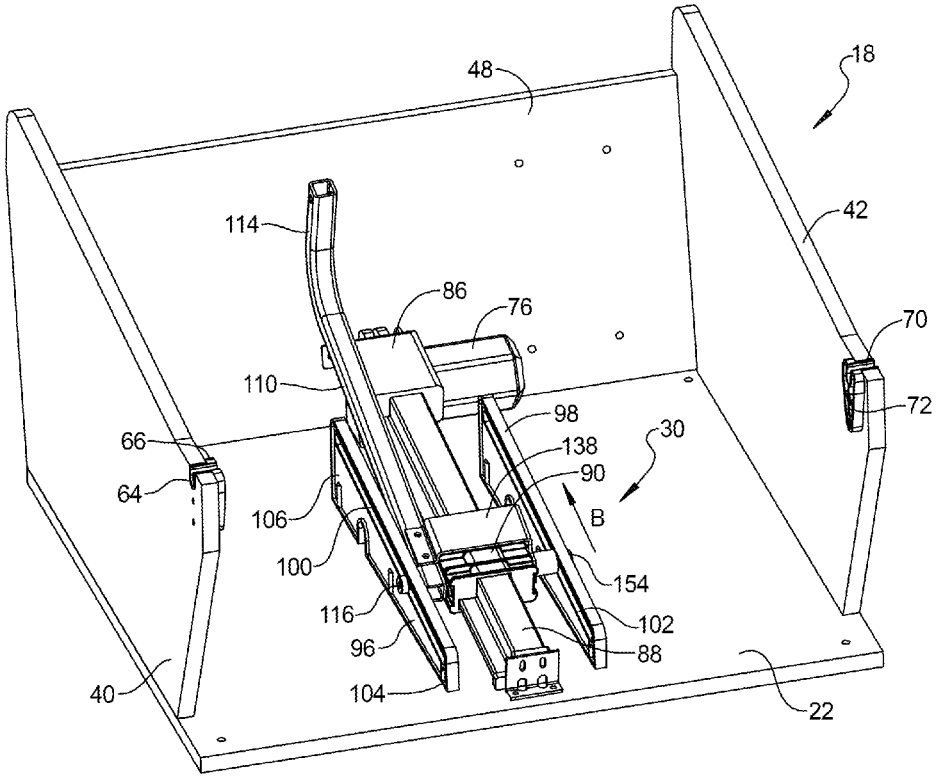
FIG. 4 is the front left perspective view of FIG. 3 showing the assembled power lift mechanism.
Figure 17:
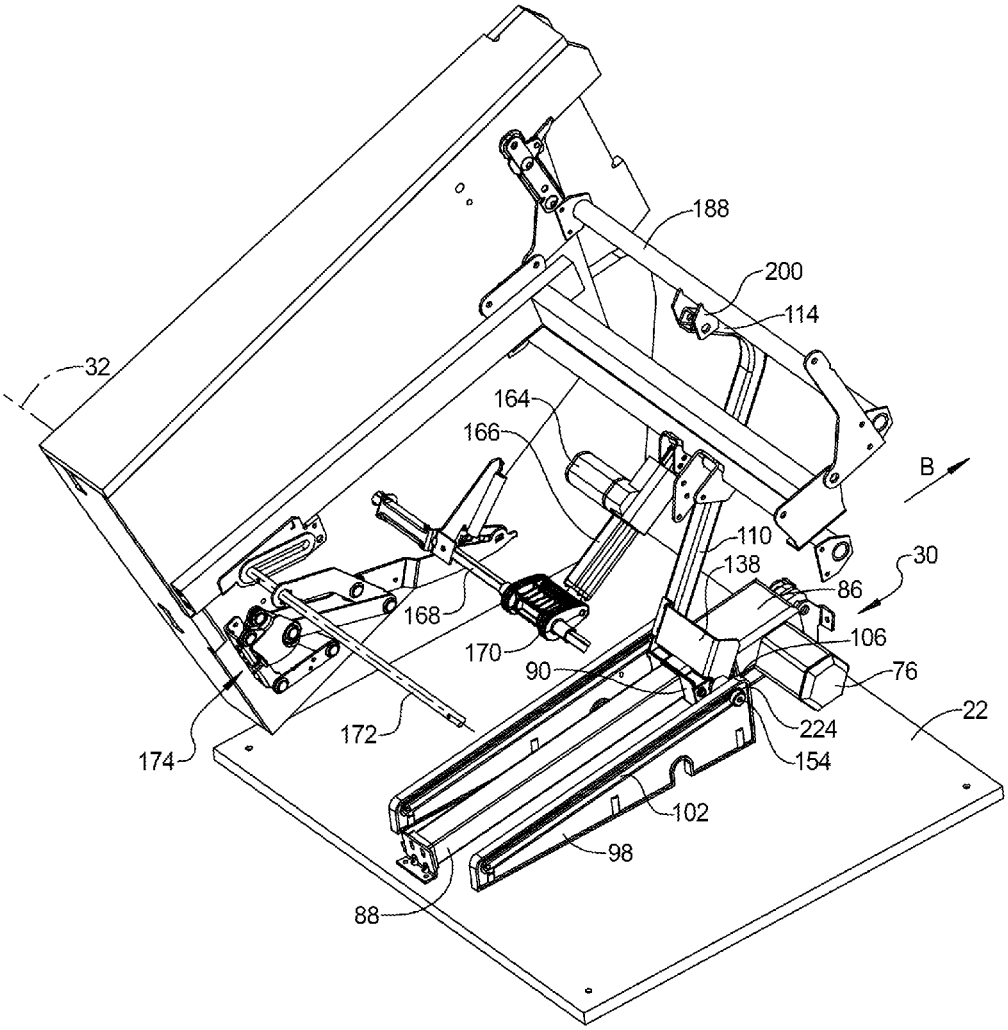
FIG. 17 is a partial front left perspective view of the furniture member of FIG. 2.

Referring to FIG. 17 and again to FIGS. 3 and 4, most of the structural components of lift chair 10 have been removed for clarity such that the right hand components for operation of leg rest member 16 are shown, and the components of lift mechanism portion 30 are visible when left chair is in the maximum lift position. The leg rest drive motor 164 is not operated during the rotation to the lift chair full lift position. The drive rod connecting member 170 is therefore in its fully retracted position as is first pantograph linkage set 174. As worm gear slide 90 is displaced in the slide lifting direction "B", which is rearward with respect to the occupant of lift chair 10, the connection bracket 138 as well as lift bar 110 rotate such that second tube portion 114 connected to clevis 200 provides maximum lift to the tube assembly 188. As worm gear slide 90 moves in the slide lifting direction "B", the shoulder bolts, such as second shoulder bolt 154 shown, slide within the elongated slots, such as elongated slot 102 shown, toward the high elevation end 106 of the first and second guide members 96, 98. The rearward displacement of worm gear slide 90, as well as the increased elevation of the shoulder bolts, provides the maximum lift position. When the shoulder bolts 116, 154 reach the slot rear end wall 224 of each of the respective first and second elongated slots 100, 102, the maximum lift position is reached. Lift chair 10 will remain at the full lift position until the occupant redirects operation of lift motor 76 to return lift chair 10 to the nominal position shown in FIG. 1 or to any of the other operating positions described herein.

Figure 8:
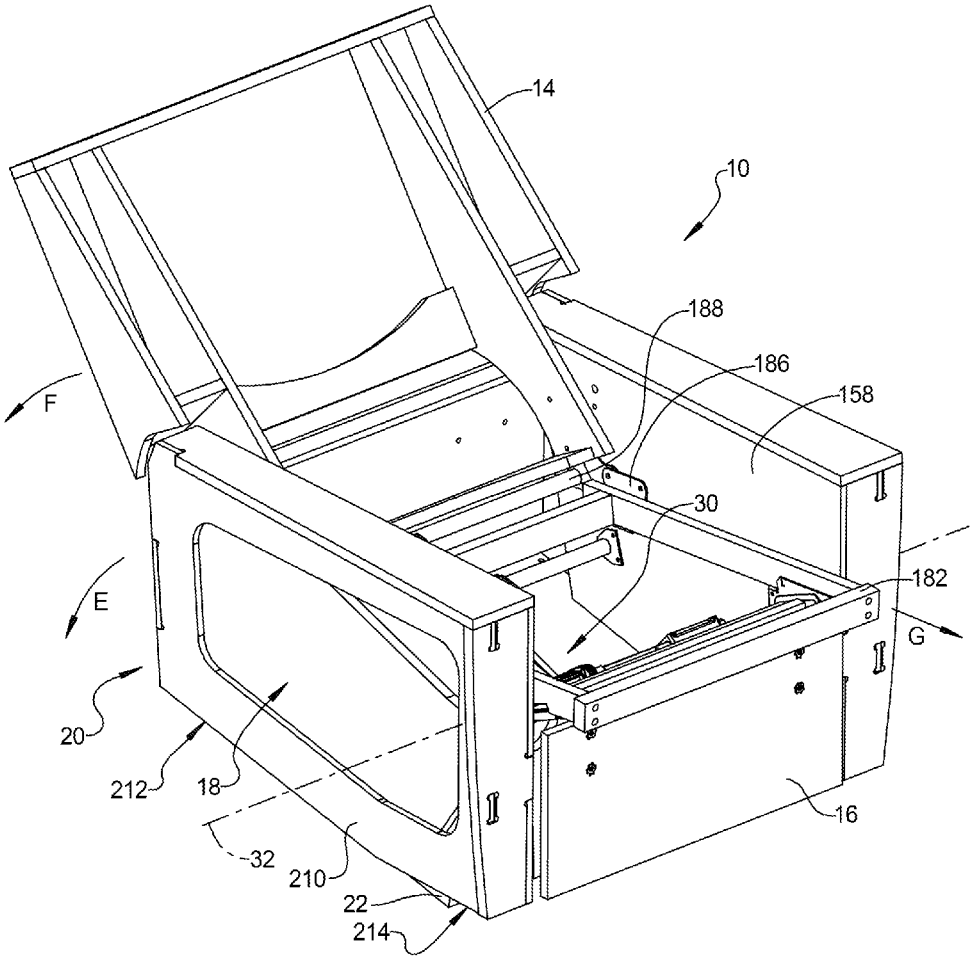
FIG. 8 is a front right perspective view of the furniture member of FIG. 1 in a rearward tilt and seatback rotated position.

Referring to FIG. 18 and again to FIG. 8, in the chair rearward tilt position provided by operation of lift mechanism portion 30, chair portion 20 is rotated in the chair downward rotational direction "E" until the first frame lower face 212 is parallel with or in contact with upper face 58 of base platform 22. The chair rearward tilt position, having seat back assembly 14 in its furthest upright position, results in a lowest position for lift bar 110 with respect to base platform 22. During the transition toward the chair rearward tilt position, the shoulder bolts 116, 154 displace in the first and second elongated slots 100, 102 in the slide returning direction "C", moving toward a slot forward end wall 232. At the chair rearward tilt position, the frame member lower end 218 of chair frame rear connecting member 216 is at its lowest elevation position and positioned proximate to base platform 22.

Figure 19:
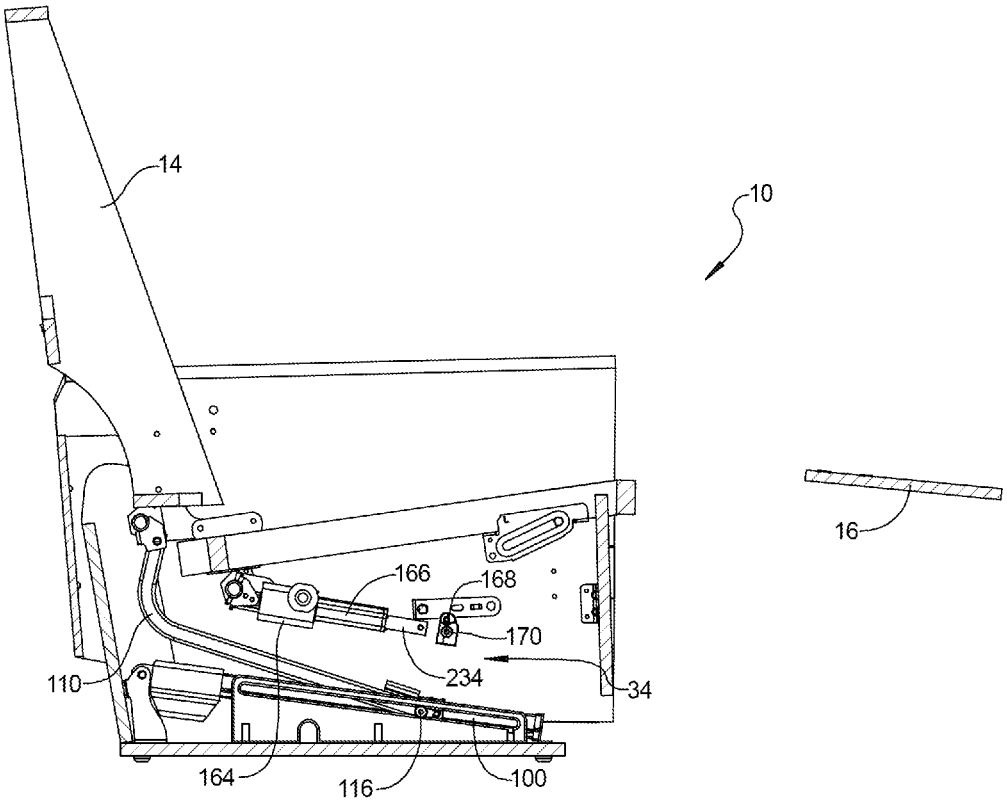
FIG. 19 is a cross sectional right side elevational view of the furniture member of FIG. 13 further showing the chair in a leg rest fully extended position.

Referring to FIG. 19 and again to FIG. 9, in the chair upright leg rest extended position of lift chair 10, the leg rest mechanism portion 34 is operated such that an extending drive shaft 234, extended by operation of leg rest drive motor 164 from drive connecting member 166, displaces drive rod connecting member 170 and thereby rotates drive rod 168. Rotation of drive rod 168, as previously described, extends leg rest member 16 to the fully extended position. Lift bar 100 and the shoulder bolts 116, 154, such as first shoulder bolt 116 shown, are in positions corresponding to the nominal position of lift chair 10 shown in FIG. 1. The only operation required to extend leg rest member 16 is therefore operation of the leg rest mechanism portion 34 by operation of leg rest drive motor 164.

Figure 18:
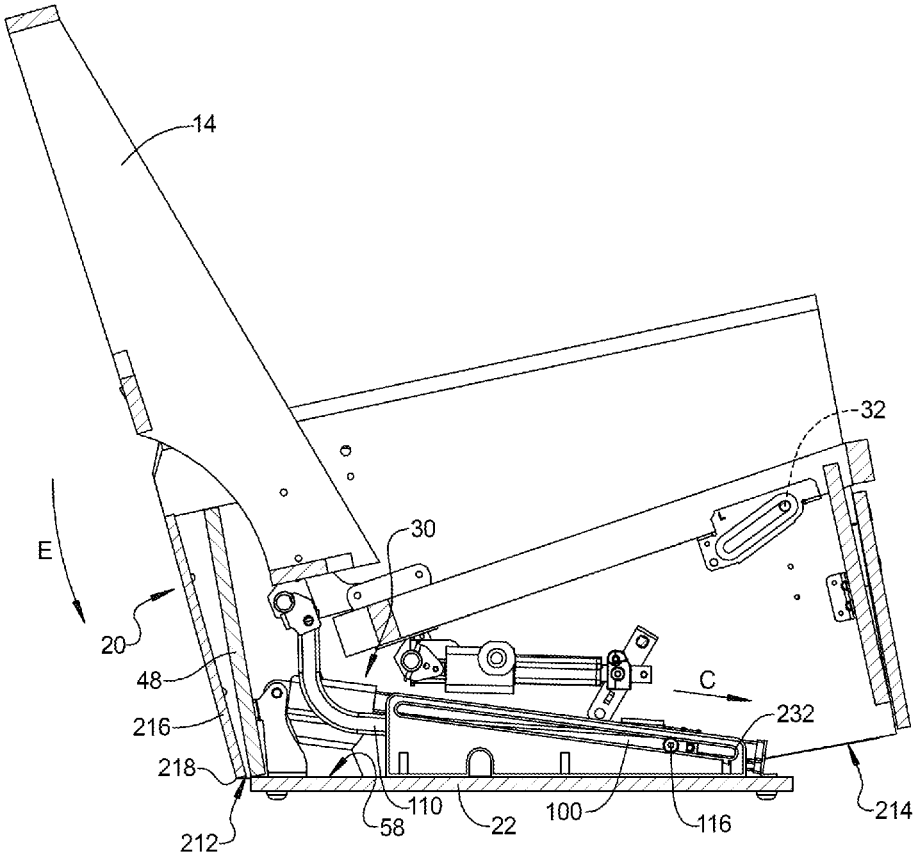
FIG. 18 is a cross sectional right side elevational view of the furniture member of FIG. 13 further showing the chair in a rearward tilt position.

Referring to FIG. 20 and again to FIG. 18, to change from the chair rearward tilt position shown in FIG. 18 to further achieve the maximum seat back assembly 14 rearward rotation in the seat back reclining direction "F", lift mechanism portion 30 is operated to displace worm gear slide 90 in the slide returning direction "C" further forward than its position in the nominal position of lift chair 10. Worm gear slide 90 therefore moves in the slide returning direction "C" until the shoulder bolts 116, 154, such as first shoulder bolt 116 shown, contact the slot forward end wall 232 of the first and second elongated slots 100, 102. At this position, lift bar 110 is elevated compared to the chair rearward tilt position shown in FIG. 18, which allows the full rearward rotation of seat back assembly 14 and forward displacement of seat frame 182 in the seat frame extending direction "G". Again, a maximum chair rearward tilt position can be achieved while the leg rest member 16 is in its fully stowed position.

Figure 20:
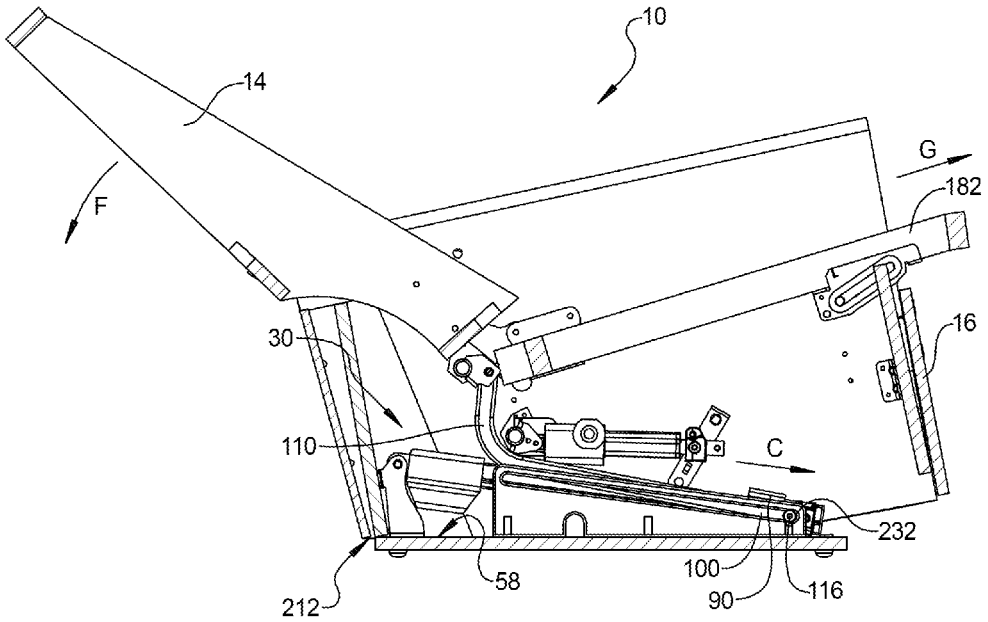
FIG. 20 is a cross sectional right side elevational view of the furniture member of FIG. 18 further showing the chair in a seatback fully reclined position.

Referring to FIG. 21 and again to FIG. 20, to change from the maximum chair rearward tilt position shown in FIG. 20 to further include the full extension of leg rest member 16, when the operation of lift mechanism portion 30 is completed, leg rest mechanism portion 34 can be further operated to extend leg rest member 16 to its fully extended position shown.

With reference to FIGS. 22-28, another furniture member 500 is provided. The structure and function of the furniture member 500 may be similar or identical to that of the lift chair 10 described above, apart from any exceptions noted below. Therefore, similar features will not be described in detail.

Figure 24:
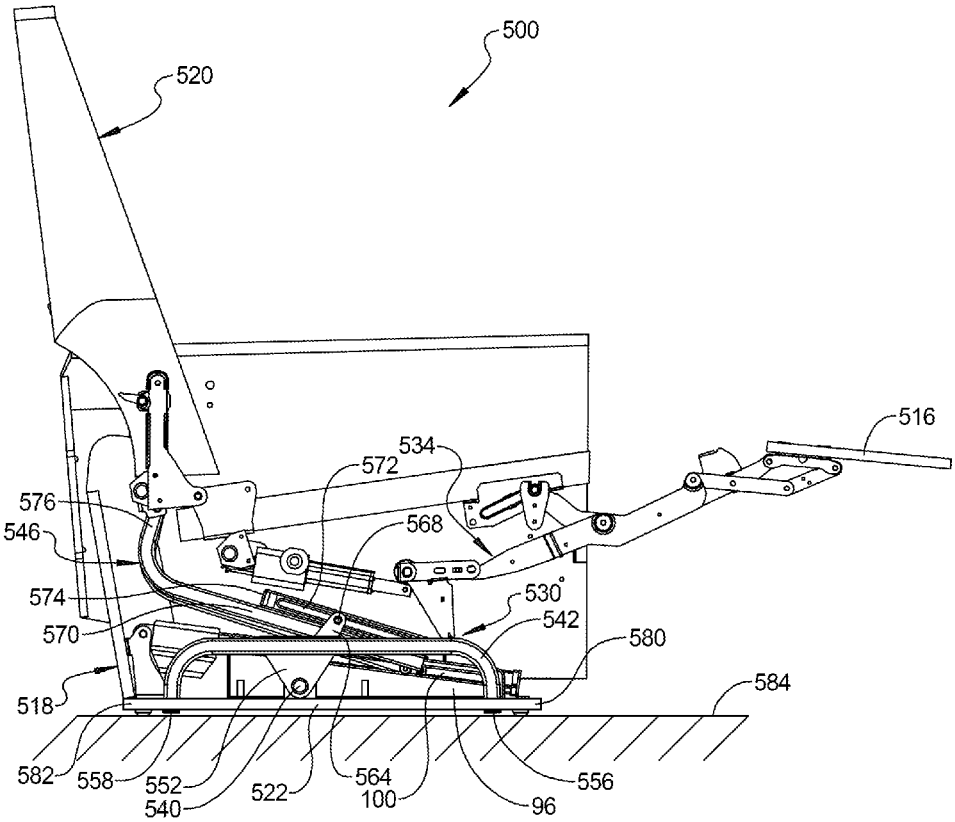
FIG. 24 is a right side elevational view of the furniture member in a nominal position with a legrest mechanism in an extended position.
Figure 25:
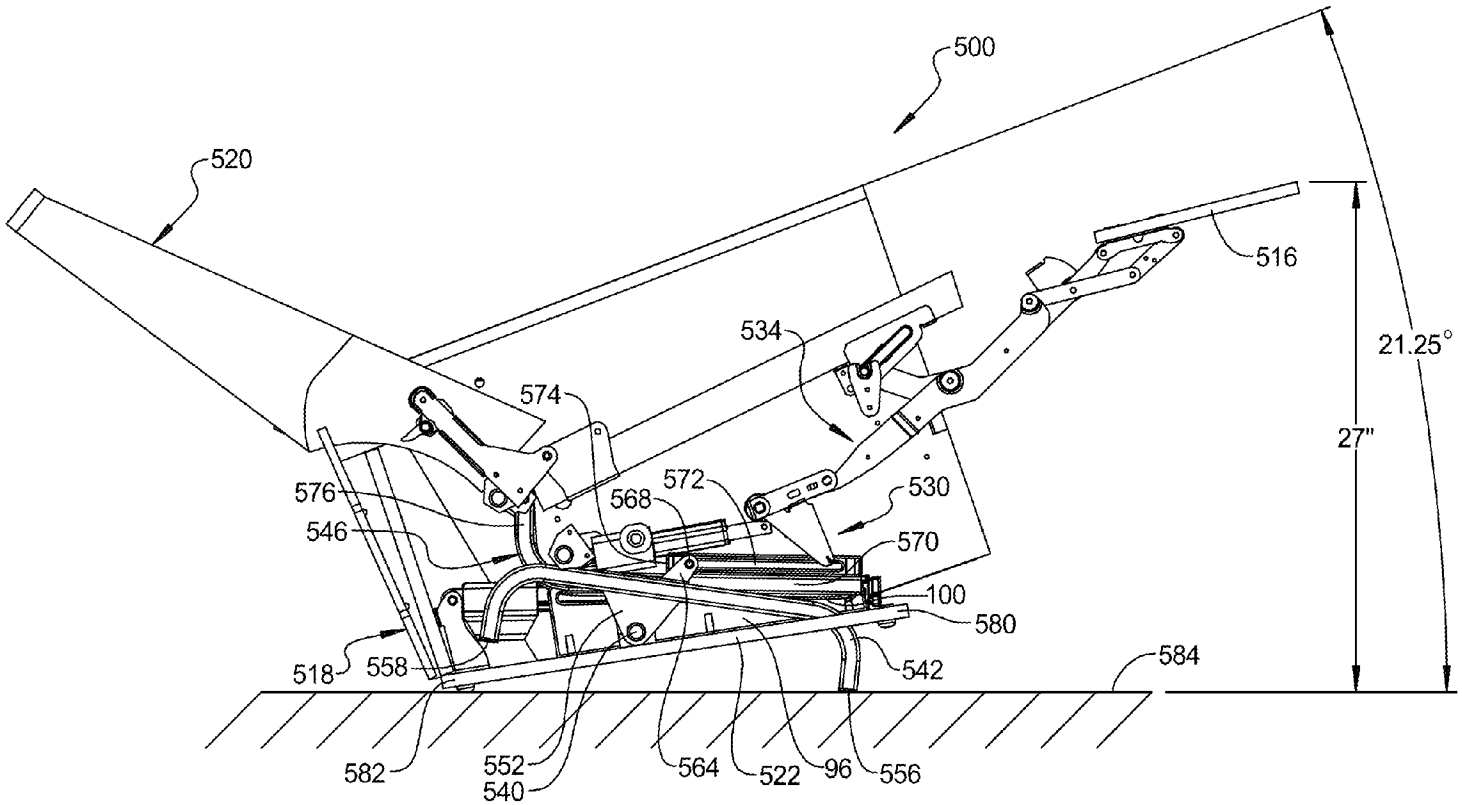
FIG. 25 is a right side elevational view of the furniture member in a fully reclined position.
Figure 27:
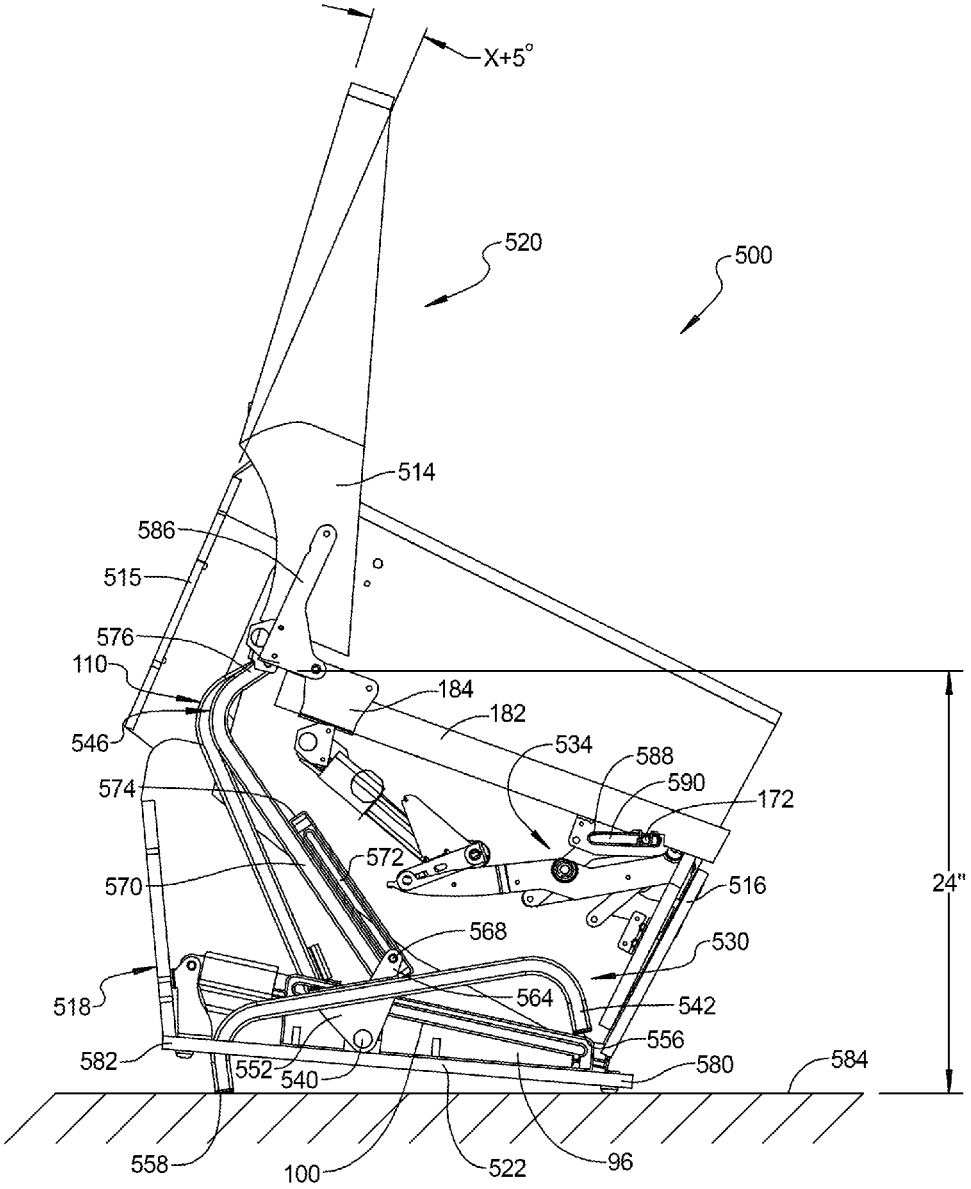
FIG. 27 is a right side elevational view of the furniture member in a full lift position.

Briefly, the furniture member 500 may include a base portion 518 and a chair portion 520 that is rotatably mounted to the base portion 518. A lift/recline mechanism 530 is mounted to a base platform 522 of the base portion 518 and is operable to move the chair portion 520 and the base portion 518 among a nominal position (FIG. 22), a "zero-gravity tilt position" or a fully reclined position (FIG. 25) and a fully lifted position (FIG. 27). It will be appreciated that the lift/recline mechanism 530 can move the base portion 518 and the chair portion 520 to any position between the reclined and lift positions. A legrest mechanism 534 is coupled to the chair portion 520 and a legrest member 516 and is operable to move the legrest member 516 relative to the base portion 518 and the chair portion 520 between a retracted position (FIGS. 22 and 27) and an extended position (FIGS. 24 and 25). The legrest mechanism 534 may be operable independently of the lift/recline mechanism 530. The structure and function of the legrest mechanism 534 may be similar or identical to that of the legrest mechanism 34 described above, and therefore, will not be described again in detail.

The structure and function of the lift/recline mechanism 530 may be similar to that of the mechanism 30 described above, apart from any exceptions described herein and/or shown in the figures. Therefore, similar features will not be described again in detail. Like the mechanism 30, the mechanism 530 may include the motor 76, the worm drive assembly 88, the first and second guide members 96, 98, and the lift bar 110 (shown in FIG. 23). As described above, operation of the motor 76 causes the slide 90 to move along the worm assembly 88 and the first and second guide members 96, 98. As described above, a first end of the lift bar 110 is coupled to the slide 90 and a second end of the lift bar 110 is coupled to the tube assembly 188, which in turn, is coupled to the chair portion 520.

Figure 22:
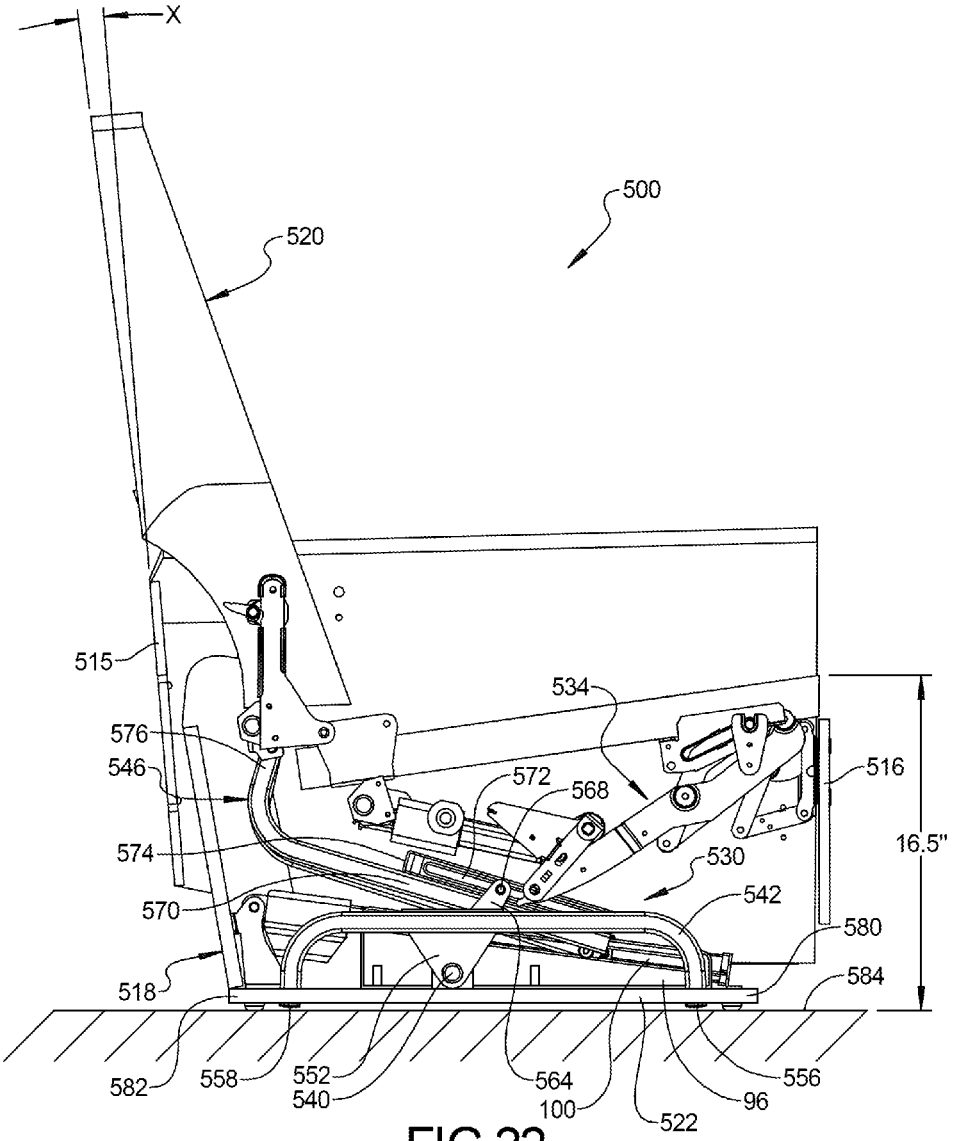
FIG. 22 is a right side elevational view of another furniture member (with a right armrest removed) in a nominal position.
Figure 23:
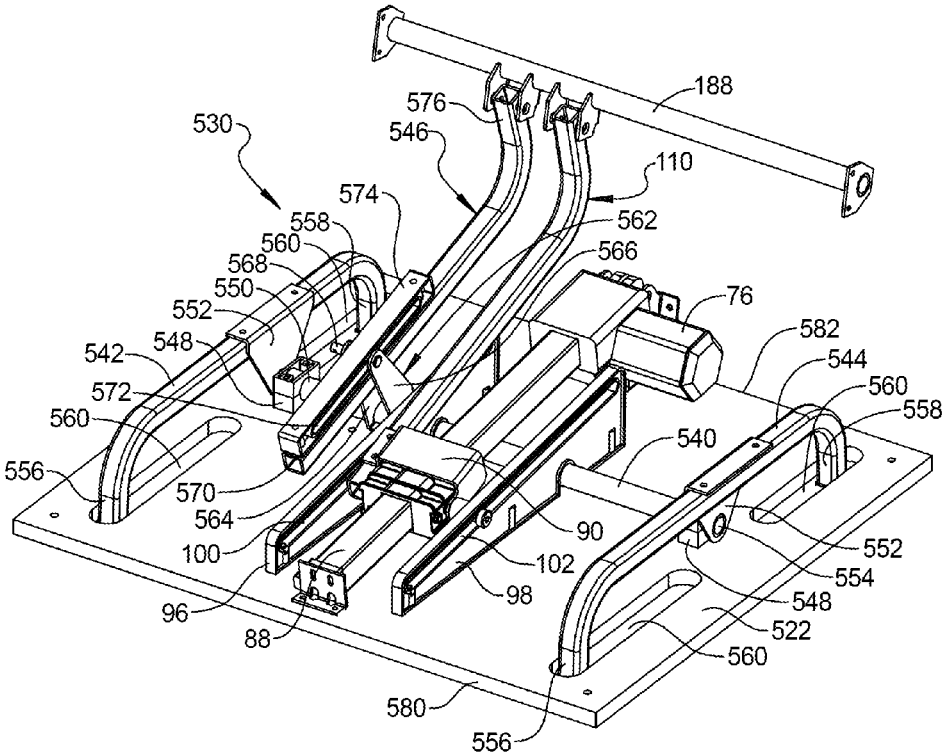
FIG. 23 is a perspective view of a mechanism of the furniture member of FIG. 22 in the nominal position.

As shown in FIG. 23, the lift/recline mechanism 530 also includes an axle 540, first and second legs 542, 544, and a generally L-shaped extension bar 546. The axle 540 is rotatably supported by a pair of bearing blocks 548 that are fixedly mounted to the base platform 522. A first end 550 of the axle 540 may be fixedly mounted to the first leg 542 by a bracket 552. A second end 554 of the axle 540 may be fixedly mounted to the second leg 44 by another bracket 552. In this manner, the axle and the first and second legs 542, 544 are rotatable with each other relative to the base portion 518 and the chair portion 520 (see FIGS. 22, 25 and 27).

Figure 26:
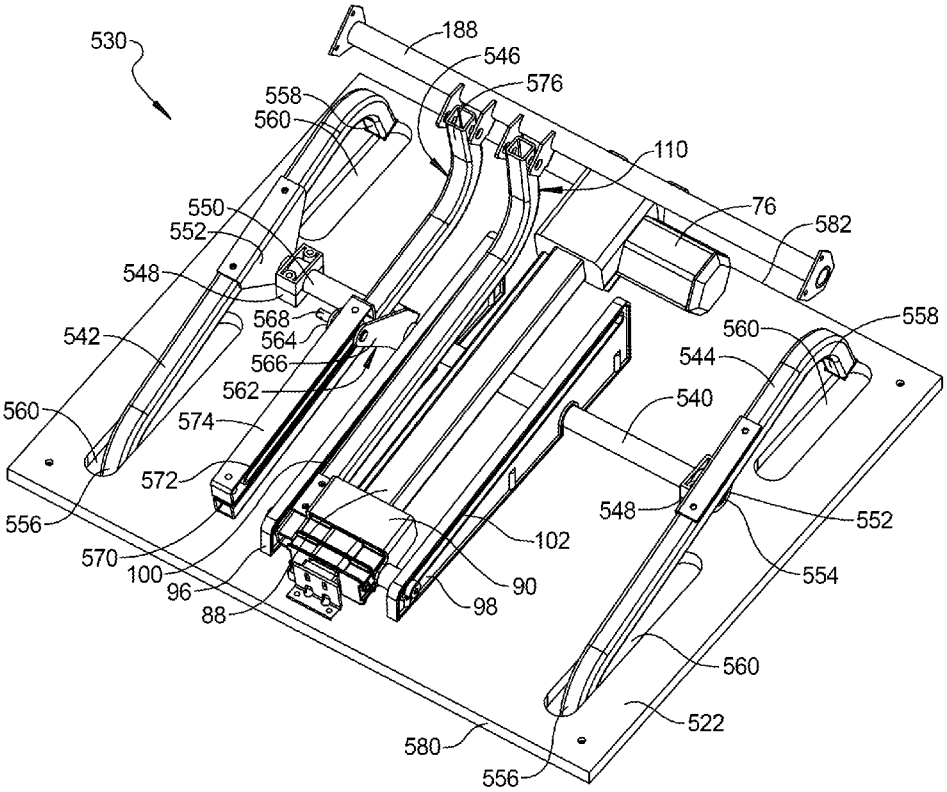
FIG. 26 is a perspective view of the mechanism in the fully reclined position.
Figure 28:
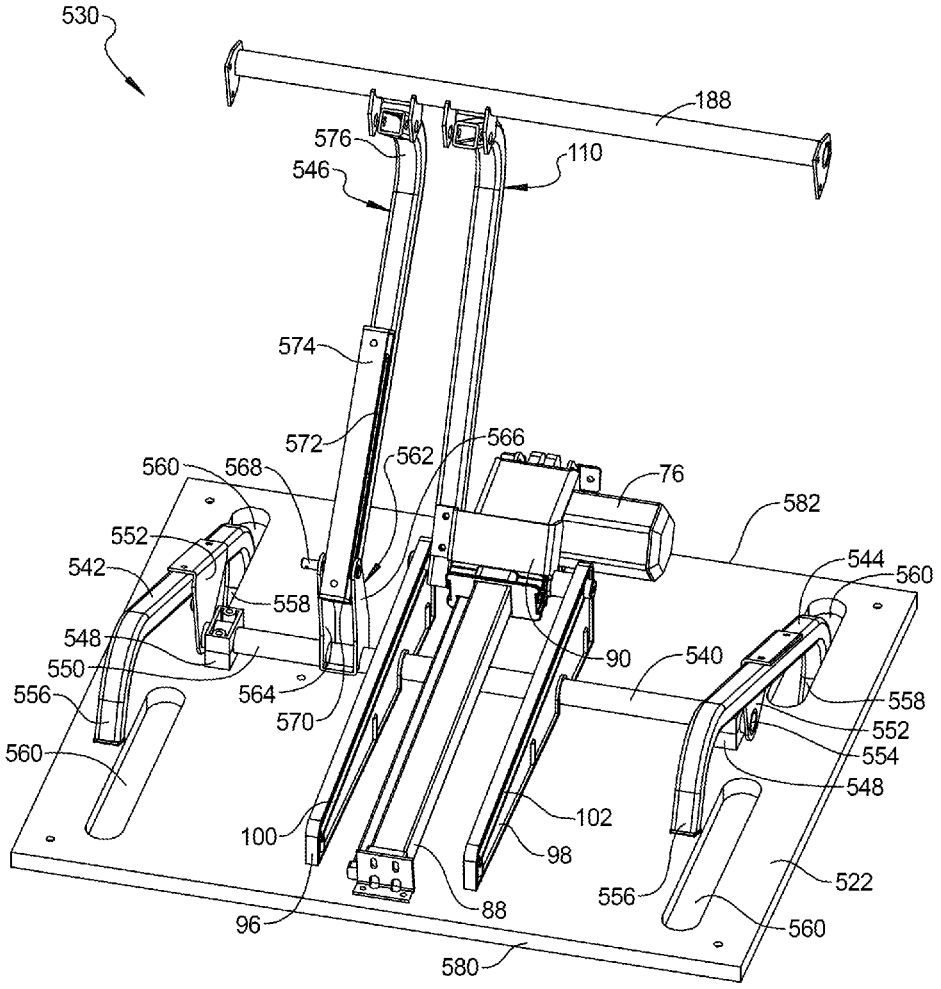
FIG. 28 is a perspective view of the mechanism in the full lift position.

The first and second legs 542, 544 may be generally U-shaped members that each includes a fore foot 556 and an aft foot 558. The base platform 522 may include a plurality of apertures 560 each of which are generally aligned with a corresponding one of the feet 556, 558 of the first and second legs 542, 544. As shown in FIGS. 23, 26 and 28, the apertures 560 allow the feet 556, 558 to extend through the base platform 522, as will be described in more detail below.

Figure 29:
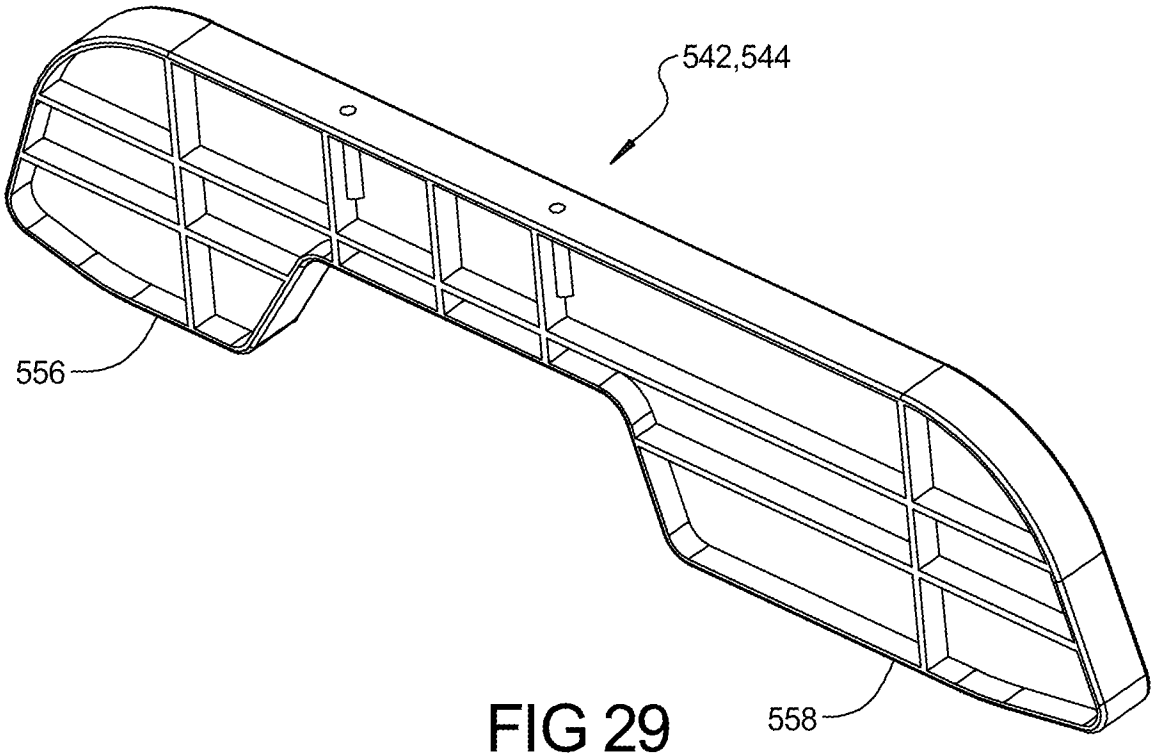
FIG. 29 is a perspective view of an alternative configuration of a leg member of the furniture member of FIGS. 22-28.

FIG. 29 depicts an alternative configuration of the legs 542, 544. The configuration shown in FIG. 29 may be a molded plastic, metal or composite component, rather than a tubular metal, plastic or composite component. The configuration shown in FIG. 29 attaches to the mechanism 530 in the same way as the configuration shown in FIGS. 22-28 and also functions in the same way.

As shown in FIG. 23, another bracket 562 is fixedly attached to the axle 540 between the first end 550 and the first guide member 96. The bracket 562 includes first and second members 564, 566 that engage a peg or pin 568. A first portion 570 of the extension bar 546 is disposed between the first and second members 564, 566 and includes an elongated slot 572 that slidably receives the pin 568 so that the extension bar 546 can slide relative to the bracket 562 and axle 540. As shown in FIG. 23, the slot 572 can be formed in a block 574 fixedly mounted to the extension bar 546, or the slot 572 can be formed in an integrally formed portion of the extension bar 546. A length of the slot 572 is shorter than the lengths of the first and second slots 100, 102 of the first and second guide members 96, 98. A second portion 576 of the extension bar 546 may be pivotably coupled to the tube assembly 188.

With continued reference to FIGS. 22-28, operation of the mechanism 530 will be described in detail. As described above, the mechanism 530 moves the base portion 518 and the chair portion 520 among the nominal position (FIG. 22), the reclined position (FIG. 25) and the lifted position (FIG. 27). In the nominal position, fore and aft portions 580, 582 of the base platform 522 may contact a flat ground surface 584 upon which the furniture member 500 is situated and support the entire weight of the furniture member 500. In some configurations, the fore and aft feet 556, 558 of the first and second legs 542, 544 may contact the ground surface 584 and support the entire weight of the furniture member 500 in the nominal position. In the reclined position, the fore feet 556 of the first and second legs 542 and the aft portion 582 of the base platform 522 may contact the ground surface 584 and support the entire weight of the furniture member 500. In the lifted position, the aft feet 558 of the first and second legs 542 and the fore portion 580 of the base platform 522 may contact the ground surface 584 and support the entire weight of the furniture member 500.

When the mechanism 530 moves from the nominal position (FIGS. 22 and 23) to the reclined position (FIGS. 25 and 26), operation of the motor 76 in a first direction causes the slide 90 to move along the worm drive assembly 88 and the first and second guide members 96, 98 toward the forward-most position (as shown in FIG. 26). Because the lift bar 110 is connected to the slide 90 and the chair portion 520, this movement of the slide 90 toward the forward-most position causes the chair portion 520 to move toward the reclined position. As the slide 90 moves toward the forward-most position, the pin 568 of the bracket 562 of the axle 540 slides relative to the slot 572 of the extension bar 546 until the pin 568 contacts the rearward-most end of the slot 572 (as shown in FIG. 26). While the pin 568 is sliding relative to the slot 572, the axle 540 remains stationary relative to the base platform 522. Once the pin 568 contacts the rearward-most end of the slot 572, continued movement of the slide 90 toward the forward-most position causes the extension bar 546 to rotate the axle 540 and the legs 542, 544 in a first rotational direction so that the fore feet 556 of the legs 542, 544 protrude through the corresponding apertures 560 in the base platform 522 (as shown in FIGS. 25 and 26). As the fore feet 556 extend further through the apertures 560, the fore portion 580 of the base platform 522 is lifted off of the ground 584 to further recline the furniture member 500 to the fully reclined position shown in FIG. 25.

When the mechanism 530 moves from the nominal position (FIGS. 22 and 23) to the lifted position (FIGS. 27 and 28), operation of the motor 76 in a second direction (opposite the first direction) causes the slide 90 to move along the worm drive assembly 88 and the first and second guide members 96, 98 toward the rearward-most position (as shown in FIG. 28). Because the lift bar 110 is connected to the slide 90 and the chair portion 520, this movement of the slide 90 toward the rearward-most position causes the chair portion 520 to move toward the lifted position. As the slide 90 moves toward the rearward-most position, the pin 568 of the bracket 562 of the axle 540 slides relative to the slot 572 of the extension bar 546 until the pin 568 contacts the forward-most end of the slot 572 (as shown in FIG. 28). While the pin 568 is sliding relative to the slot 572, the axle 540 remains stationary relative to the base platform 522. Once the pin 568 contacts the forward-most end of the slot 572, continued movement of the slide 90 toward the rearward-most position causes the extension bar 546 to rotate the axle 540 and the legs 542, 544 in a second direction (opposite the first direction) so that the aft feet 558 of the legs 542, 544 protrude through the corresponding apertures 560 in the base platform 522 (as shown in FIGS. 27 and 28). As the aft feet 558 extend further through the apertures 560, the aft portion 582 of the base platform 522 is lifted off of the ground 584 to further lift the furniture member 500 to the fully lifted position shown in FIG. 27.

Figure 21:
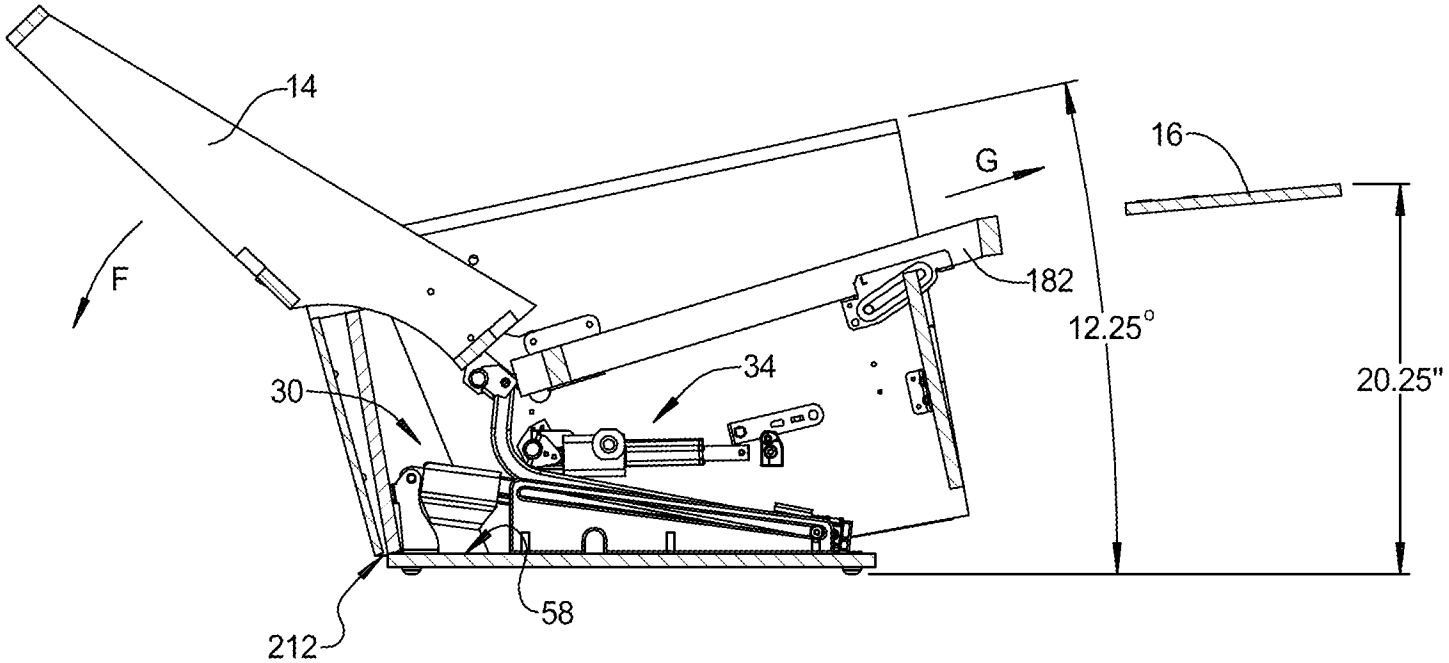
FIG. 21 is a cross sectional right side elevational view of the furniture member of FIG. 20 further showing the chair in a leg rest fully extended position.

Providing the legs 542, 544 and moving the legs 542, 544 to the positions shown in FIGS. 25 and 27 provides the furniture member 500 with an increased range of motion relative to the chair 10 shown in FIGS. 1-21. While the seat heights of chair 10 and the furniture member 500 in the nominal positions may be the same (e.g., 16.5 inches, as shown in FIGS. 13 and 22), the extra range of motion provided by the mechanism 530 relative to the mechanism 30 results in a significant increase in legrest height and recline angle of the furniture member 500 in the fully reclined positions. A comparison of FIGS. 21 and 25 shows that for exemplary embodiments of the chair 10 and furniture member 500, providing the mechanism 530 with the rotatable legs 542, 544 increases the legrest height of the furniture member 500 by about 6.75 inches (e.g., from 20.25 inches to 27 inches) and increases the recline angle of the furniture member 500 by about nine degrees (e.g., from 12.25 degrees to 21.25 degrees).

The additional range of motion provided by rotating the legs 542, 544 to the "zero-gravity tilt" position shown in FIG. 25 may be particularly comfortable for many users, as the user's feet (resting on the extended legrest 516) will be positioned at or near the vertical level (i.e., the vertical distance off of the ground 584) of the user's heart. This "zero-gravity" positioning of the user's body in the furniture member 500 promotes restfulness and relaxation.

Figure 16:
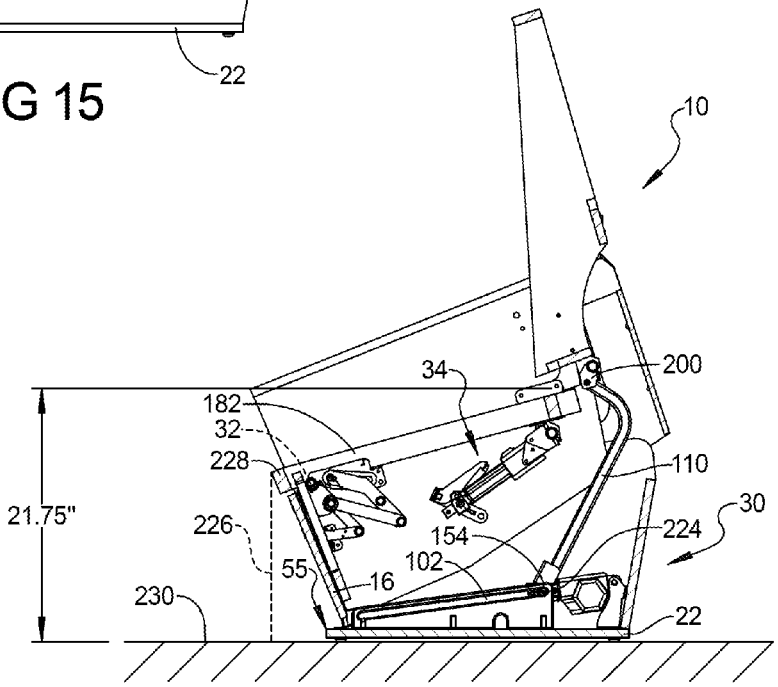
FIG. 16 is a cross sectional side elevational view of the furniture member of FIG. 2 taken at section 16 of FIG. 12.

The extra range of motion provided by the mechanism 530 relative to the mechanism 30 also results in a significant increase in the seat height of the furniture member 500 relative to the chair 10 in the fully lifted positions. A comparison of FIGS. 16 and 27 shows that for exemplary embodiments of the chair 10 and furniture member 500, providing the mechanism 530 with the rotatable legs 542, 544 increases the seat height of the furniture member 500 by about 3.25 inches (e.g., from 21.75 inches to 24 inches).

The additional lift provided by rotating the legs 542, 544 to the position shown in FIG. 27 provides additional lift of a user seated in the furniture member 500 toward a standing position, thereby reducing the amount of effort and strength required of the user to stand up out of the furniture member 500. This may be particularly beneficial for elderly or physically disabled users.

The furniture member 500 may also include structure that causes the seatback frame 514 to recline backward relative to the seat frame 182 and frame member 515 by approximately five degrees, for example, when the furniture member 500 is in the lifted position to prevent unwanted pressure on the occupants head and/or shoulders during when the occupant is getting up out of the furniture member 500 to a standing position. A comparison of FIGS. 22 and 27 illustrate this five-degree recline of the seatback frame 514 (FIG. 22 shows an angle X between seatback frame 514 and frame member 515 in the nominal position, and FIG. 27 shows an angle of X+5 degrees in the lifted position).

As shown in FIG. 27, a pivot bracket 586 is connected to the tube assembly 188, the seatback frame 514 and the seat frame 182 (via swing assemblies 184). A pair of slide brackets 588 are attached to the seat frame 182. The slide brackets 588 include slots 590 that slidably receive the shaft 172. As the furniture member 500 is moved into the lifted position, the weight of the seat frame 182 (and the rest of the seat bottom assembly supported by the seat frame 182) causes the seat frame 182 and slide brackets 588 (and the rest of the seat bottom assembly) to slide forward relative to the shaft 172, which causes relative rotation between the seat frame 182 and the seatback frame 514, whereby the seatback frame 514 reclines backward approximately five degrees. The pivot bracket 586 and the interface between the slide brackets 588 and the shaft 172 allow the balance of weight of the seatback, the seat bottom and the mechanism 530 to determine the amount that the seatback reclines in the lifted position. Therefore, in some embodiments, the seatback may recline by an amount more or less than five degrees in the lifted position.

While the mechanisms 530, 534 are described above as being power mechanisms driven by motors 76, 164, in some configurations, either or both of the mechanisms 530, 534 could be manual (i.e., not motor-driven) mechanisms.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member comprising:

a frame assembly including a chair portion movable relative to a base portion among a nominal position, a reclined position and a lift position; and a motor attached to the base portion;

a slide member connected to the motor and displaceable relative to the base portion in first and second directions by selective operation of the motor;

a first bar connected to the slide member and the chair portion, the first bar moving the chair portion among the nominal position, the reclined position and the lift position in response to operation of the motor;

an axle rotatably mounted to the base portion;

first and second leg members attached to respective first and second ends of the axle, each of the first and second leg members including a fore foot and an aft foot; and a second bar connected to the chair portion and slidably connected to the axle, the second bar rotating the axle in a first direction in response to movement of the chair portion into the reclined position and rotating the axle in a second direction in response to movement of the chair portion into the lift position.

2. The furniture member of claim 1, wherein the fore feet of the first and second leg members extend through the base portion in the reclined position so that an aft portion of the base and fore feet of the first and second leg members are supporting a weight of the furniture member with a fore portion of the base portion spaced apart from a ground surface upon which the furniture member is situated.

3. The furniture member of claim 2, wherein the aft feet of the first and second leg members extend through the base portion in the lift position so that the fore portion of the base and aft feet of the first and second leg members are supporting the weight of the furniture member with the aft portion of the base portion spaced apart from the ground surface.

4. The furniture member of claim 3, wherein the first and second leg members are generally U-shaped members.

5. The furniture member of claim 4, wherein the base portion includes a plurality of apertures through which the fore and aft feet of the first and second leg members are extendable.

6. The furniture member of claim 1, wherein the aft feet of the first and second leg members extend through the base portion in the lift position so that a fore portion of the base and aft feet of the first and second leg members are supporting a weight of the furniture member with an aft portion of the base portion spaced apart from a ground surface upon which the furniture member is situated.

7. The furniture member of claim 1, further comprising a legrest mechanism including a legrest linkage and a legrest member that are moveable between an extended position and a retracted position independently of movement of the first and second bars.

8. The furniture member of claim 7, wherein the legrest mechanism includes a legrest motor that drivingly engages the legrest linkage.

9. The furniture member of claim 1, wherein the axle is rotatably supported by bearing blocks that are fixedly mounted to the base portion.

10. The furniture member of claim 9, wherein the first and second leg members are fixedly attached to the axle by first and second brackets, respectively.

11. The furniture member of claim 1, wherein the second bar includes an elongated slot that slidably receives a peg that is fixedly attached to the axle.

12. The furniture member of claim 11, wherein the slide connected to the first bar has a range of motion that is longer than the elongated slot so that the peg slides along the elongated slot of the second bar for only a portion of the range of motion of the slide.

13. The furniture member of claim 12, wherein continued motion of the slide in a rearward direction past a position of the slide corresponding to initial contact between the peg and a fore end of the elongated slot causes rotation of the axle and the first and second leg members in a first rotational direction relative to the base portion.

14. The furniture member of claim 13, wherein continued motion of the slide in a forward direction past a position of the slide corresponding to initial contact between the peg and an aft end of the elongated slot causes rotation of the axle and the first and second leg members in a second rotational direction relative to the base portion.

15. The furniture member of claim 1, wherein an angle between a seatback of the chair portion and a seat bottom of the chair portion increases by a predetermined amount when the chair portion is moved from the nominal position to the lift position.

16. The furniture member of claim 15, wherein the predetermined amount is approximately five degrees.

17. A furniture member comprising:

a base member including fore and aft end portions;

a chair frame movable relative to the base member among a nominal position, a reclined position and a lift position;

a mechanism moving the chair frame relative to the base member among the nominal, reclined and lift positions; and first and second leg members each having fore and aft feet movably mounted to the base member such that the fore feet extend through the base member in the reclined position and the aft feet extend through the base member in the lift position, wherein the fore and aft end portions of the base support a weight of the furniture member in the nominal position, the fore feet and the aft end portion support the weight in the reclined position, and the aft feet and the fore end portion support the weight in the lift position.

18. The furniture member of claim 17, wherein the mechanism includes a motor attached to the base member, a slide member connected to the motor, and a first bar connected to the slide member and the chair frame.

19. The furniture member of claim 18, further comprising:

an axle rotatably mounted to the base member; and a second bar connected to the chair frame and slidably connected to the axle, the second bar rotating the axle in a first direction in response to movement of the chair frame into the reclined position and rotating the axle in a second direction in response to movement of the chair frame into the lift position.

20. The furniture member of claim 19, wherein the second bar includes an elongated slot that slidably receives a peg that is fixedly attached to the axle.

21. The furniture member of claim 20, wherein the slide member connected to the first bar has a range of motion that is longer than the elongated slot so that the peg slides along the elongated slot of the second bar for only a portion of the range of motion of the slide member.

22. The furniture member of claim 21, wherein continued motion of the slide member in a rearward direction past a position of the slide member corresponding to initial contact between the peg and a fore end of the elongated slot causes rotation of the axle and the first and second leg members in a first rotational direction relative to the base member.

23. The furniture member of claim 22, wherein continued motion of the slide member in a forward direction past a position of the slide member corresponding to initial contact between the peg and an aft end of the elongated slot causes rotation of the axle and the first and second leg members in a second rotational direction relative to the base member.

24. The furniture member of claim 23, wherein the axle is rotatably supported by bearing blocks that are fixedly mounted to the base member.

25. The furniture member of claim 24, wherein the first and second leg members are fixedly attached to the axle by first and second brackets, respectively.

26. The furniture member of claim 17, wherein the base member includes a plurality of apertures through which the fore and aft feet of the first and second leg members are extendable.

27. The furniture member of claim 17, further comprising a legrest mechanism including a legrest linkage and a legrest member that are moveable between an extended position and a retracted position independently of movement of the first and second leg members.

28. The furniture member of claim 27, wherein the legrest mechanism includes a legrest motor that drivingly engages the legrest linkage.

29. The furniture member of claim 17, wherein the first and second leg members are generally U-shaped members.

30. The furniture member of claim 17, wherein an angle between a seatback of the chair frame and a seat bottom of the chair frame increases by a predetermined amount when the chair frame is moved from the nominal position to the lift position.

31. The furniture member of claim 30, wherein the predetermined amount is approximately five degrees.

* * * * *